US010130131B2

(12) United States Patent
Ryou

(10) Patent No.: US 10,130,131 B2
(45) Date of Patent: Nov. 20, 2018

(54) CONTROLLER, BAND, AND BAND ADJUSTING DEVICE INCLUDING THE CONTROLLER AND THE BAND

(71) Applicant: Yang-Seog Ryou, Suwon-si (KR)

(72) Inventor: Yang-Seog Ryou, Suwon-si (KR)

( * ) Notice: Subject to any disclaimer, the term of this patent is extended or adjusted under 35 U.S.C. 154(b) by 239 days.

(21) Appl. No.: 14/952,700

(22) Filed: Nov. 25, 2015

(65) Prior Publication Data

US 2016/0198783 A1 Jul. 14, 2016

(30) Foreign Application Priority Data

Jan. 8, 2015 (KR) ..... 10-2015-0002576
Nov. 9, 2015 (KR) ..... 10-2015-0156625
Nov. 18, 2015 (KR) ..... 10-2015-0161682

(51) Int. Cl.

| | |
|---|---|
| ***A44B 11/00*** | (2006.01) |
| ***A41F 1/00*** | (2006.01) |
| ***A41F 9/02*** | (2006.01) |
| ***A44B 11/25*** | (2006.01) |
| ***A44C 5/20*** | (2006.01) |

(52) U.S. Cl.

CPC ..... *A41F 1/008* (2013.01); *A41F 9/025* (2013.01); *A44B 11/2592* (2013.01); *A44C 5/2042* (2013.01)

(58) Field of Classification Search

CPC ..... A41F 1/008; A41F 9/025; A44B 11/2592; A44C 5/2042

See application file for complete search history.

(56) References Cited

U.S. PATENT DOCUMENTS 751,407 A * 2/1904 Perryman ..... A44B 11/12 24/170
762,732 A * 6/1904 Luhmann ..... A44B 11/12 24/170
1,635,135 A * 7/1927 Mix ..... A44B 11/12 24/191
1,643,083 A * 9/1927 Otten ..... A44B 11/12 24/191
4,281,441 A * 8/1981 Rasner ..... A44B 11/2592 24/700
4,727,630 A 3/1988 Alan
5,572,747 A * 11/1996 Cheng ..... A44B 11/12 2/312
5,579,563 A * 12/1996 Sim ..... A41F 9/002 24/170

(Continued)

FOREIGN PATENT DOCUMENTS

JP 11-323642 A 11/1999
JP 2000-303233 A 10/2000

(Continued)

OTHER PUBLICATIONS

KR Office Action dated Jan. 18, 2017 as received in Application No. 10-2015-0156625.

(Continued)

*Primary Examiner* — Jason W San
(74) *Attorney, Agent, or Firm* — Maschoff Brennan

(57) ABSTRACT

Disclosed herein is a controller which allows a movement of a band in a first direction to be free but allows a movement of the band in a second direction to be selective.

11 Claims, 66 Drawing Sheets

(56) References Cited

U.S. PATENT DOCUMENTS 5,727,259 A * 3/1998 Kawamata ..... A44B 11/2592 2/452
6,219,889 B1 * 4/2001 Lovato ..... A44B 11/12 24/170
6,508,080 B1 * 1/2003 Ninomiya ..... A44C 5/2042 24/574.1
6,715,449 B1 * 4/2004 Jordan ..... A01K 27/005 119/863
7,836,561 B2 * 11/2010 Vaccaro ..... A63B 33/002 2/450
7,901,260 B2 * 3/2011 Godoy ..... A63B 31/11 441/64
7,921,523 B2 * 4/2011 Chou ..... A63B 33/002 2/426
8,561,267 B2 * 10/2013 Chang ..... A44B 11/12 211/89.01
8,763,210 B2 * 7/2014 Vincent ..... A43B 5/04 24/68 SK
9,241,543 B1 * 1/2016 Peng ..... A44B 11/008
9,351,526 B1 * 5/2016 Taylor ..... A44B 11/12
9,351,539 B2 * 5/2016 Briggs ..... A43C 11/146
9,775,410 B2 * 10/2017 Szewczyk ..... A44B 11/125
2002/0189056 A1 * 12/2002 Gallina ..... A44B 11/12 24/68 R
2003/0041420 A1 * 3/2003 Kosh ..... A44B 11/12 24/193
2003/0172499 A1 * 9/2003 Uehara ..... A44B 11/12 24/170
2006/0090305 A1 * 5/2006 Aquillon ..... A44C 5/2042 24/265 WS
2010/0257706 A1 * 10/2010 Bak ..... A44C 5/2042 24/490
2013/0008056 A1 * 1/2013 Vincent ..... A43B 5/04 36/117.1
2013/0042446 A1 * 2/2013 Tseng ..... A41F 1/008 24/68 R
2014/0096348 A1 * 4/2014 Anderson ..... A44B 11/2526 24/633
2015/0223571 A1 8/2015 Ryou
2017/0065034 A1 * 3/2017 Tsai ..... A44B 11/12

FOREIGN PATENT DOCUMENTS

JP 2001-131816 A 5/2001
JP 2004-044021 A 2/2004
JP 2007-154368 A 6/2007
KR 20-0224604 Y1 6/2001
KR 20-0407563 Y1 1/2006
KR 10-2006-0105636 A 10/2006
KR 10-1265161 B1 5/2013
KR 10-1274672 B1 6/2013
KR 10-1293266 B1 8/2013

OTHER PUBLICATIONS

KR Office Action dated Jan. 18, 2017 as received in Application No. 10-2015-0161682.
KR Notice of Allowance dated May 30, 2016 as received in Application No. 10-2015-0002576 [Machine Translation].
KR Office Action dated Jan. 8, 2015 as received in Application No. 10-2015-0002576.

* cited by examiner

1200a

1200a

2000

CONTROLLER, BAND, AND BAND ADJUSTING DEVICE INCLUDING THE CONTROLLER AND THE BAND

CROSS-REFERENCE TO RELATED APPLICATION

This application claims priority to and the benefit of Korean Patent Application Nos. 10-2015-0002576 filed on Jan. 8, 2015, 10-2015-0156625 filed on Nov. 9, 2015 and 10-2015-0161682 filed on Nov. 18, 2015 the disclosure of which is incorporated herein by reference in its entirety.

BACKGROUND

1. Field of the Invention

The present invention relates to a controller, a band, and a band adjusting device, and more particularly, to a controller, a band, and a band adjusting device which reduces a size thereof and provides convenience to a user.

2. Discussion of Related Art

An object of the use of buckle devices is to reduce or increase a width of an attached material such as conventional clothing or a bag has been well known.

Buckle devices used for attached materials each basically include a band and a buckle, in which the buckle fastens both ends or is provided on a waist part of pants or a skirt to adjust a waistline of the pants or skirt to fit on a waistline of a wearer.

Also, buckle devices are used to reduce or enlarge an inlet of a bag or a handbag or used for a watch strap to adjust a length of the watch strap to be appropriate for a wrist of a wearer.

Buckles used as described above may freely slide due to pulling a band in a direction of tightening the band, that is, in a forward direction but may be restricted in movement in a direction of releasing the band, that is, a reverse direction to maintaining a tightened state.

General buckles each include, to provide the use described above, a buckle housing through which a band passes, a button rotatably mounted in the buckle housing, a holding means moved by the button to control whether to restrict the band, and a spring which provides an elastic force to the button.

Here, a button provided in a general buckle protrudes toward a top of the buckle housing and is rotatable. When a user releases a tightened state of a band, this is implemented by turning the button which protrudes toward the top of the buckle housing.

However, general buckles are damaged through repetitively using the button and have poor durability and a manufacturing process thereof is complicated due to a large number of components.

SUMMARY OF THE INVENTION

It is an aspect of the present invention to provide a controller, a band, and a band adjusting device which reduces manufacturing costs by simplifying a manufacturing process and simultaneously provides convenience to a user and reduces a size thereof.

According to an aspect of the present invention, there is provided a controller which allows a movement of a band in a first direction to be freely performed but allows a movement of the band in a second direction opposite to the first direction to be selectively performed. The controller includes a body portion which includes an insertion space into which one end of the band is inserted and a discharge space through which the one end of the band inserted in the insertion space is discharged, a band control portion which is mounted to be changeable in position between a first position and a second position based on a rotation axis, is in contact with the band and allows the band to freely move in the first direction in the first position, and is not in contact with the band and allows the band to freely move in the second direction, and an elastic portion which is elastically deformed when the band control portion is changed in position from the first position to the second position due to an external force and is located to be immovable in the first direction and the second direction in an internal space of the body portion to restore the band control portion from the second position to the first position using a restoring force caused by the elastic deformation when the external force is removed. Here, the body portion is in contact with the elastic portion so as not to allow the elastic portion to move in the first direction in the internal space, and the rotation axis is in contact with the elastic portion so as not to allow the elastic portion to move in the second direction in the internal space.

The body portion may include a frame portion which defines the insertion space and the discharge space and an attached material connection portion which extends from the frame portion to be connected to an attached material, and the elastic portion may be prevented from moving in the first direction in the internal space due to contact with one surface of the attached material connection portion.

The band control portion may include a rotation implementation portion to be rotatable about the rotation axis to allow a mutual change in position between the first position and the second position, and the rotation axis may be implemented by cutting and then bending a certain area of the body portion to be inserted into an insertion hole of the rotation implementation portion.

The band control portion may include an external force receiving portion which receives the external force for implementing the movement of the band in the second direction, a holding portion which interconnects with the external receiving portion and is released from the band due to the external force, and a connection portion which connects the external force receiving portion, the holding portion, and the rotation implementation portion to one another. Here, the rotation implementation portion may extend from the connection portion at a certain angle, and the insertion hole may extend to the connection portion to prevent interference with the connection portion in a process in which a certain area of the body portion is cut and bent to implement the rotation axis.

The band control portion may include a rotation implementation portion to be rotatable on the rotation axis to allow a change in position between the first position and the second position. The rotation axis may be implemented by cutting and bending a certain area of the body portion or by a penetration pin which penetrates the body portion. The rotation implementation portion may have an open one side in the second direction to be rotatably mounted on the rotation axis due to a movement in position toward the rotation axis.

The body portion may include a frame portion which defines the insertion space and the discharge space and a separation-prevention portion which extends from the frame portion to be in contact with the band control portion to prevent a separation of the band control portion.

The band control portion may include a rotation implementation portion to be rotatable on the rotation axis to allow a mutual change in position between the first position and the second position. The separation-prevention portion may provide a through space having a certain size in the body portion to allow the rotation implementation portion to pass therethrough when the band control portion is inserted into the internal space.

The band control portion may include an external force receiving portion which receives the external force to implement the movement of the band in the second direction, a holding portion which interconnects with the external force receiving portion and is released from the band due to the external force, and a connection portion which connects the external force receiving portion with the holding portion. The connection portion may be formed to be bent from the external force receiving portion to be rounded to prevent interference with the band during a change in position.

The body portion may include a second front wall, a second rear wall, a second top wall, and a second bottom wall, which define the internal space, and a discharge-space-defining wall to allow the discharge space to be defined by a relationship with the second rear wall. The elastic portion may include a mounting portion mounted on the second front wall, a restriction portion which extends from the mounting portion to be in contact with the discharge-space-defining wall in the internal space to restrict a movement in position in the first direction, and an elastic deformation portion which extends from the mounting portion to be elastically deformed by a change of the band control portion in position.

The restriction portion and the elastic deformation portion may be bent from the mounting portion, and a boundary between the mounting portion and the elastic deformation portion may be in contact with the rotation axis to restrict a movement in position in the second direction.

The band control portion may include an external force receiving portion which receives the external force to implement the movement of the band in the second direction, a holding portion which interconnects with the external force receiving portion and is released from the band due to the external force, and a connection portion which connects the external force receiving portion with the holding portion. The second front wall may include a through hole which penetrates therethrough to allow an attached material fixing portion for connection with an attached material to pass therethrough, and a plurality of such holding portions may be provided and are spaced apart to provide an interference prevention space so as not to interfere with the attached material fixing portion.

According to another aspect of the present invention, there is provided a band used for a controller which includes a body portion and a band control portion mounted in the body portion to allow a movement of the band in a first direction to be freely performed and to allow a movement of the band in a second direction to be selectively performed. The band includes a body portion which includes a front side and a rear side and has a certain length and a hold portion which is formed on the body portion to extend in a vertical direction of the front side to allow the band control portion to be held when the body portion moves in the second direction. The body portion includes a pair of wing portions inserted into an internal space provided by the body portion and a supporting portion which supports the pair of wing portions by connecting the pair of wing portions with each other and protrudes in a longitudinal direction toward the rear side to slide through a rear wall of the body portion. The hold portion is formed on each of the pair of wing portions to be symmetrical based on the supporting portion.

The body portion may further include a pair of auxiliary wing portions which extend to be parallel with the pair of wing portions while being spaced apart from the pair of wing portions to provide a separation space in which the rear wall of the body portion is inserted.

The band may further include a movement prevention portion which protrudes in front of the pair of auxiliary wing portions while being spaced apart from the pair of wing portions and is held by the rear wall of the body portion to temporarily restrict a further movement of the pair of wing portions in the second direction when the pair of wing portions move in the second direction and the band control portion is released from all the hold portions.

The band may further include a body connection portion connected to the supporting portion while being spaced apart from the pair of wing portions to provide a separation space into which the rear wall of the body portion is inserted.

The band may further include a movement prevention portion which protrudes from the front side of the body portion the pair of auxiliary wing portions while being spaced apart from the pair of wing portions and is held by the rear wall of the body portion to temporarily restrict a further movement of the pair of wing portions in the second direction when the pair of wing portions move in the second direction and the band control portion is released from all the hold portions.

The hold portion may be formed to protrude from the front side of the body portion or to depress the same.

The hold portion may include a concave portion formed by depressing the front side of the body portion and a convex portion adjacent to the concave portion and formed to protrude.

The band may further include a thin film portion mounted on the rear side of the body portion to reduce a frictional force with the rear wall.

According to still another aspect of the present invention, there is provided a band adjusting device including the controller and the band.

BRIEF DESCRIPTION OF THE DRAWINGS

The above and other objects, features and advantages of the present invention will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
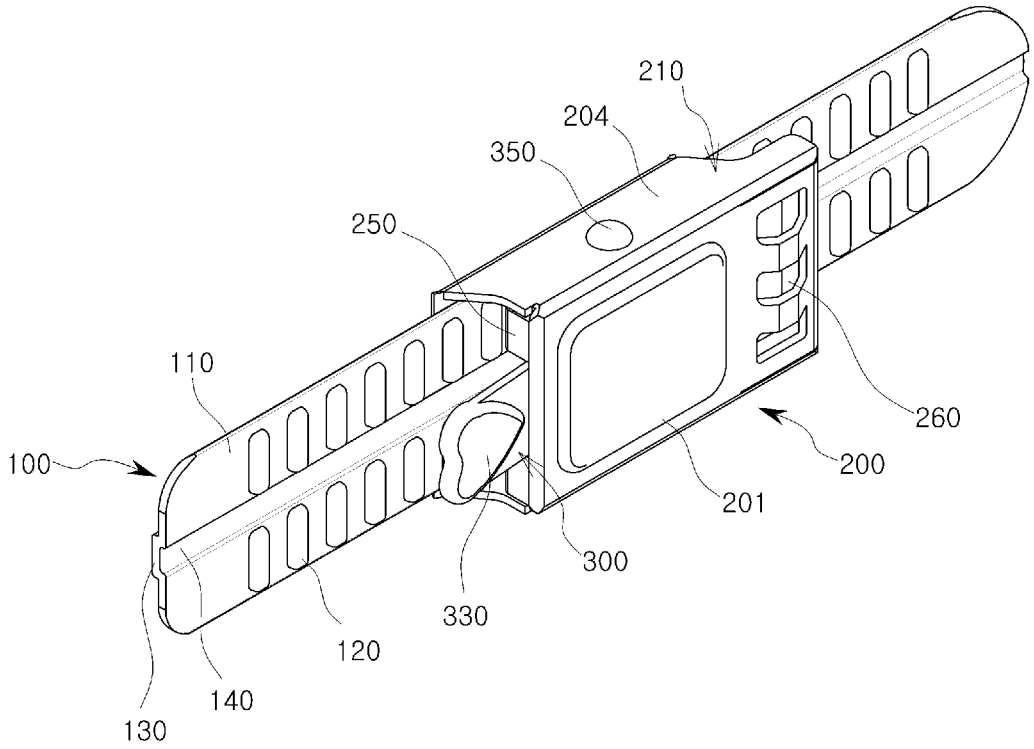
FIG. 1 is rear perspective view illustrating a coupling state of a band and a buckle according to embodiments of the present invention.

Hereinafter, specified embodiments of the present invention will be described in detail with reference to the drawings. However, the present invention is not limited to the embodiments and a person of ordinary skill in the art who understands the concept of the present invention may easily provide other examples included in retrogressive other inventions or within the technical scope of the present invention through adding other elements or changing and deleting elements within the same technical scope, which may be considered as being included in the technical scope of the present invention.

Also, like reference numerals designate like elements throughout the drawings of the respective embodiments.

Figure 2:
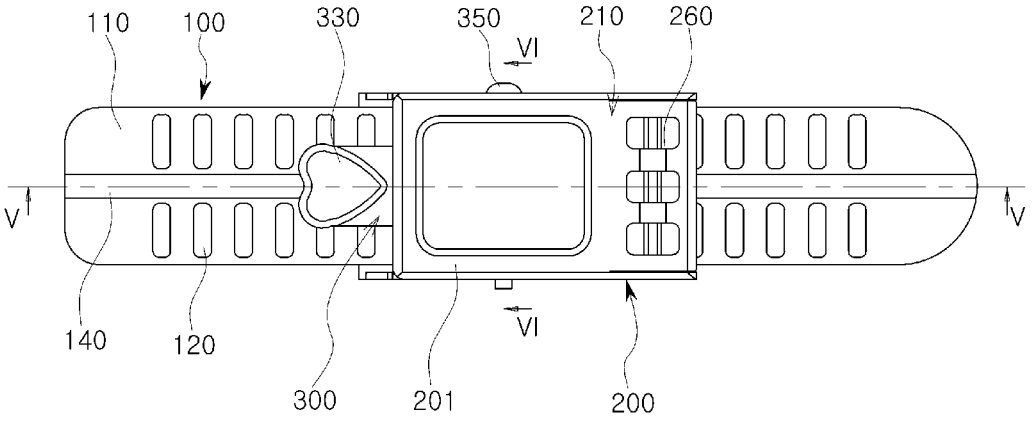
FIG. 2 is a front view illustrating the coupling state of the band and the buckle according to embodiments of the present invention.
Figure 3:
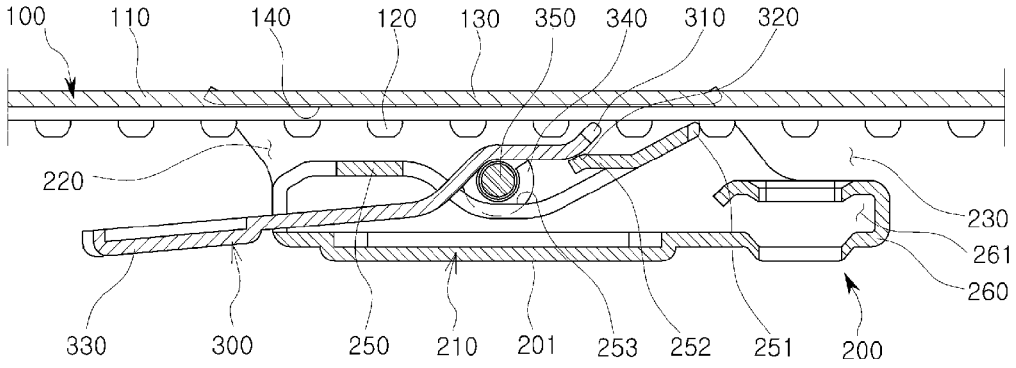
FIG. 3 is a cross-sectional view illustrating a part taken along a line V-V' shown in FIG. 2.

FIG. 1 is a rear perspective view illustrating a coupling state of a band 100 and a buckle 200 according to embodiments of the present invention. FIG. 2 is a front view illustrating the coupling state of the band 100 and the buckle 200 according to embodiments of the present invention. FIG. 3 is a cross-sectional view illustrating a part taken along a line V-V' shown in FIG. 2.

Figure 4:
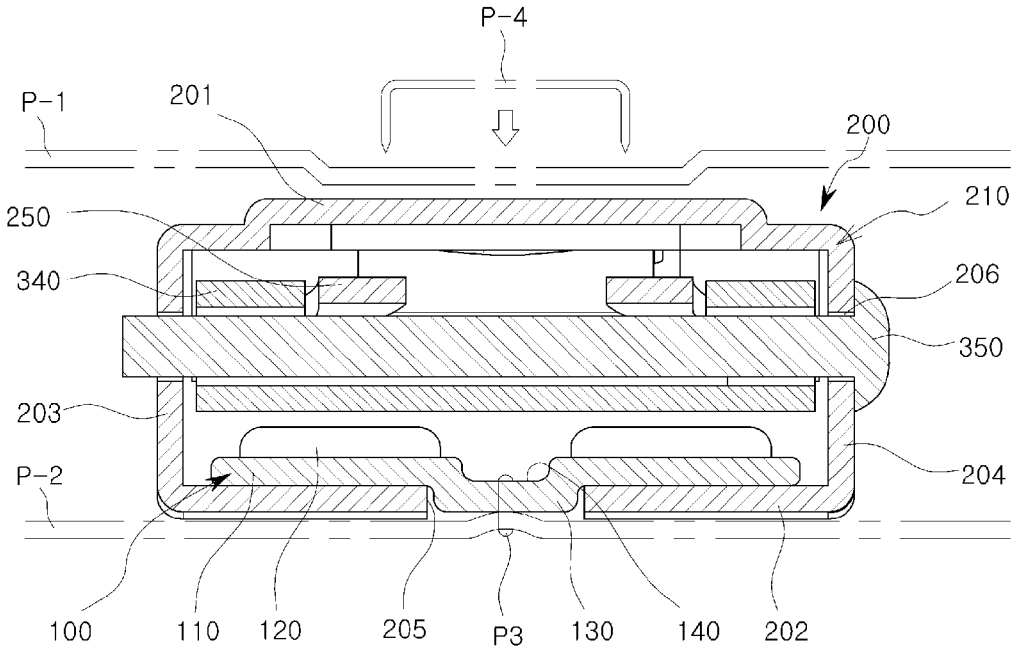
FIG. 4 is a cross-sectional view illustrating a part taken along a line VI-VI' shown in FIG. 2.
Figure 5:
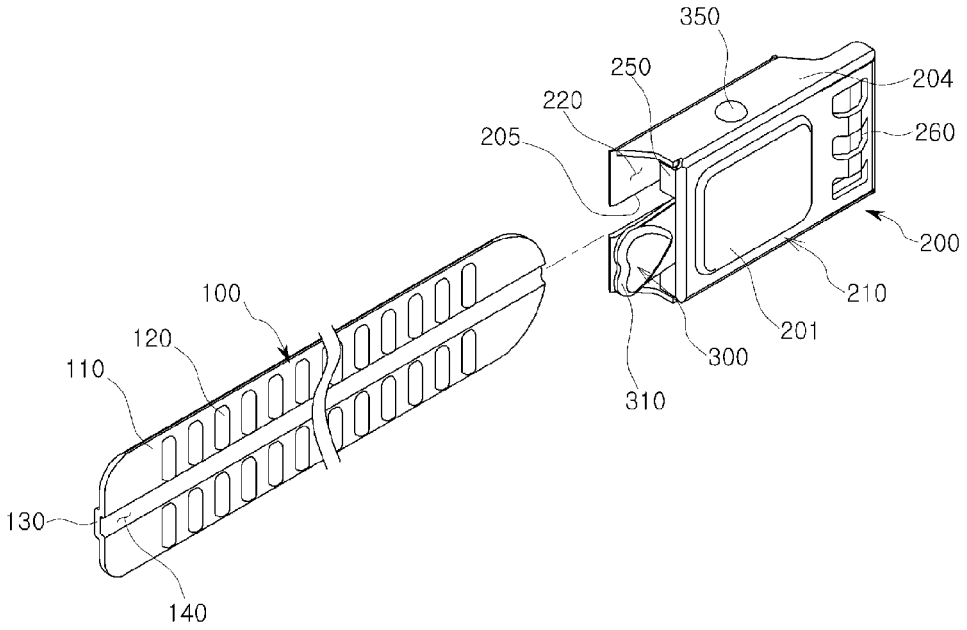
FIG. 5 is a rear exploded perspective view illustrating the coupling state of the band and the buckle according to embodiments of the present invention.
Figure 6:
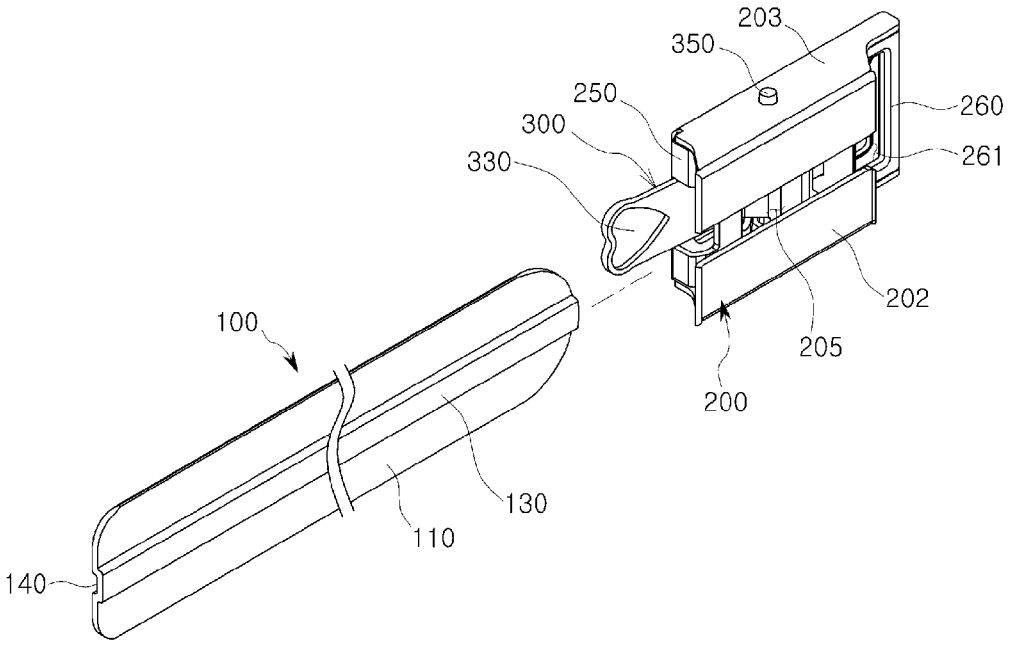
FIG. 6 is a front exploded perspective view illustrating the coupling state of the band and the buckle according to embodiments of the present invention.

FIG. 4 is a cross-sectional view illustrating a part taken along a line VI-VI' shown in FIG. 2. FIG. 5 is a rear exploded perspective view illustrating the coupling state of the band 100 and the buckle 200 according to embodiments of the present invention. FIG. 6 is a front exploded perspective view illustrating the coupling state of the band 100 and the buckle 200 according to embodiments of the present invention.

Figure 7:
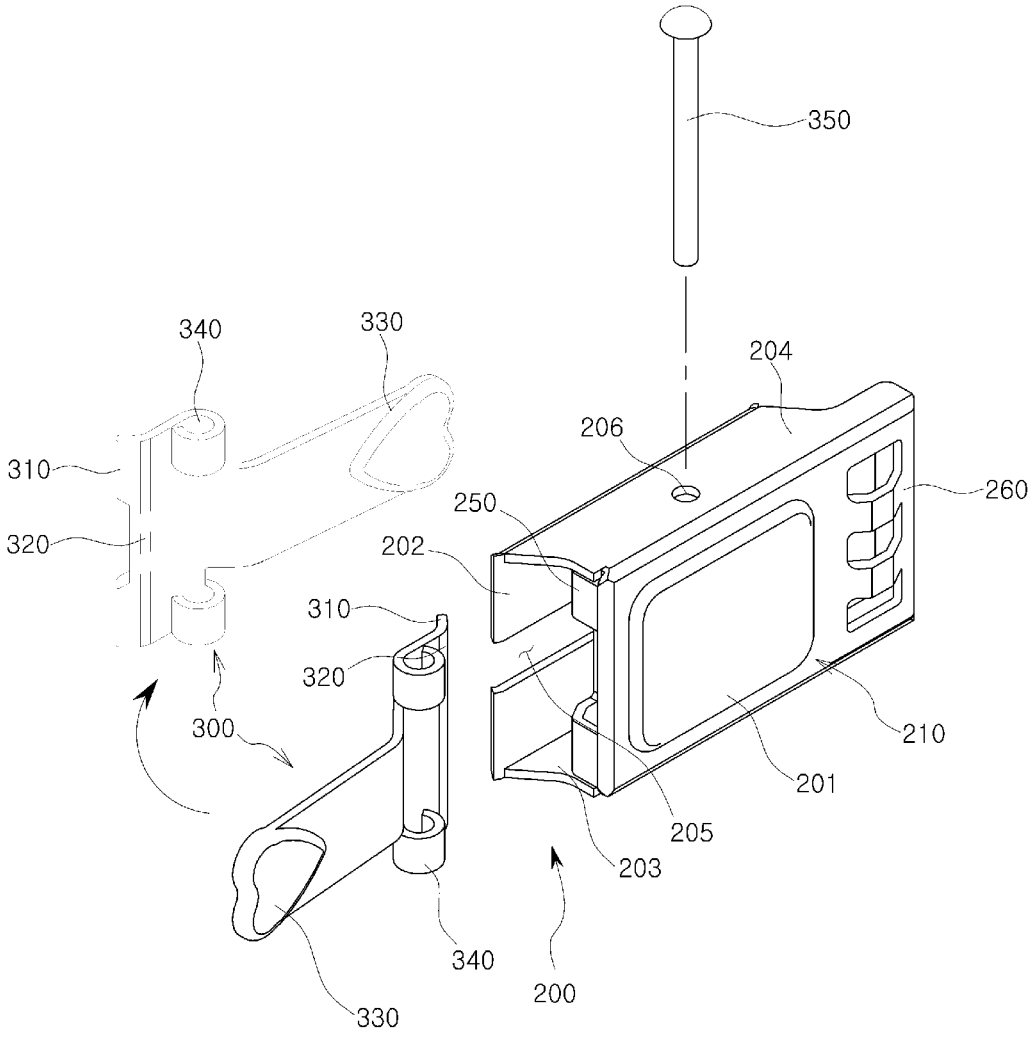
FIG. 7 is an exploded perspective view of the buckle according to embodiments of the present invention.

FIG. 7 is an exploded perspective view of the buckle 200 according to embodiments of the present invention.

Referring to the drawings, the buckle device according to embodiments of the present invention includes the band 100 and the buckle 200 which restricts sliding of the band 100.

The band 100 includes a plurality of holding protrusions 120 formed on a rear side of a body 110 at predetermined intervals. The body 110 of the band 100 is formed with a certain width and length through injection molding, and the holding protrusions which have an embossed protrusion shape are formed on the rear side of the band 100.

Here, on the body 110, a sliding protrusion portion 130 formed with a sewing groove 140 sewn on an attached material P-2 using a fixing thread P3 in a center in a longitudinal direction is protruded and the holding protrusions 120 are arranged on both sides of the sewing groove 140 while being divided at uniform intervals.

The buckle 200 includes a plate spring 250 for fixing or releasing a forward movement and a backward movement of the band 100, a fixing portion 260 connected with an attached material P-1 and a fixing pin P-4 and has a cuboid box shape which includes an inlet 220 and an outlet 230 formed by front and rear sides 201 and 202 and both lateral sides 203 and 204 thereof.

Figure 8:
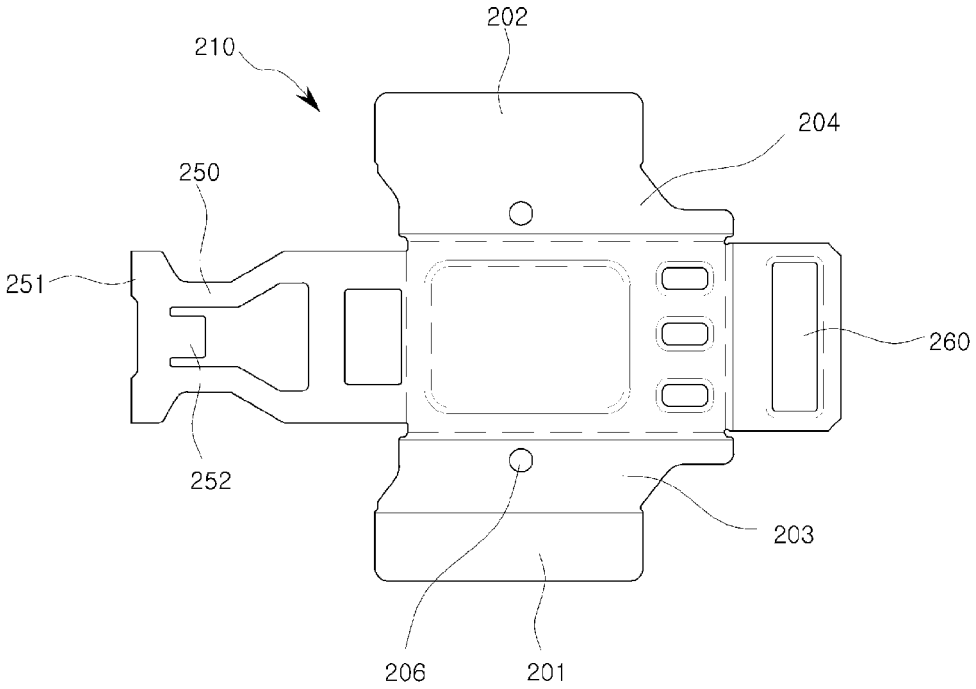
FIG. 8 is a planar figure for forming a buckle body which is a component according to embodiments of the present invention.
Figure 9:
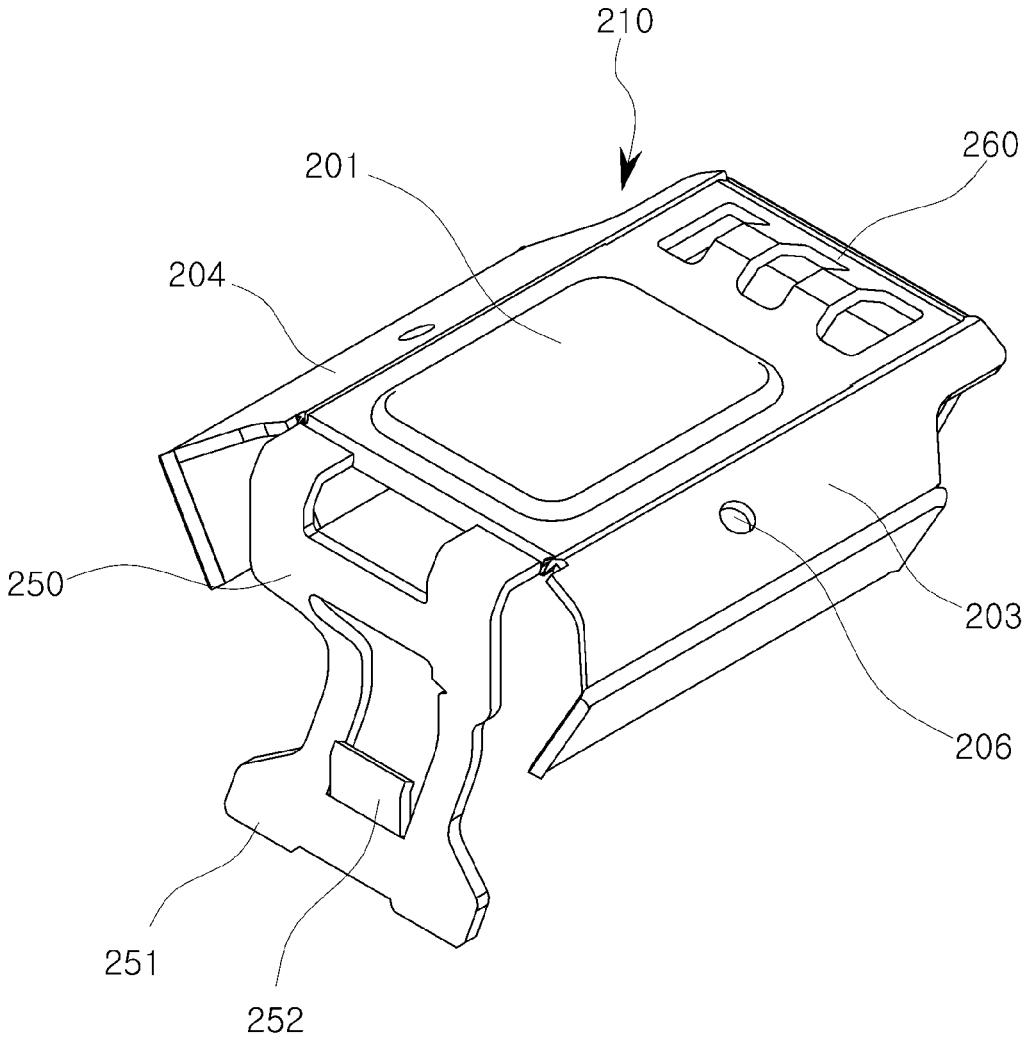
FIG. 9 is a perspective view illustrating a bent state before forming the buckle body according to embodiments of the present invention.

A buckle body 210, is formed through press forming using a planar figure formed of a metal plate as shown in FIG. 8 and stepwise bending as shown in FIG. 9 in such a way that the rear side 202, the both lateral sides 203 and 204, and the front side 201 are sequentially formed, the inlet 220 and the outlet 230 are formed, the plate spring 250 is formed by bending a side of the inlet 220, and the fixing portion 260 connected with the attached material P-1 is formed by bending a side of the outlet 230.

Due to the bending of the buckle body 210 as described above, a guide slot 205 in which the sliding protrusion portion 130 of the band 100 is slidably accommodated is formed in the rear side 202 in a longitudinal direction and the fixing portion 260 for connecting the plate spring 250 with the attached material P-1 using the fixing pin P-4 is integrally formed by bending inside the front side 201.

Here, the fixing portion 260 includes a fixing groove portion 261 which forms an internal space to allow the fixing pin P-4 which fixes the attached material P-1 to be folded.

Also, the fixing portion 260 includes a hole in a center thereof and two convexly protruding bridges to allow both legs of the fixing pin P-4 which are inserted into the hole in the center to be strongly fixed while fixing the fixing pin P-4.

The plate spring 250 provides an elastic force against bending to allow a front end thereof to be held by the holding protrusions 120 dividing the body 110 of the band 100 due to bend-molding.

The plate spring 250 includes holding bent ends 251 on both sides, which are integrally formed on one side of the rear side 202 of the buckle body 210 and bent to have an elastic force against the front side 201 to allow cross sections thereof to be held by the divided holding protrusions 120 and an elastic supporting section 252 in a rear center of the holding bent ends 251.

Here, a buckle switch 300 which separates the front end of the plate spring 250 accommodated in the buckle body 210 from the body 110 of the band 100 or restricts movements of the holding protrusions 120 is axially installed both of the lateral sides 203 and 204 of the buckle body 210.

Also, the fixing portion 260 includes the fixing groove portion 261 bent from one side of the front side 201 of the buckle body 210 toward an inside thereof to allow the attached material P-1 and the fixing pin P-4 which fixes the same to be folded in the inner space.

The buckle switch 300 may be axially installed by an axial pin 350 assembled into an axial hole which passes through both of the lateral sides 203 and 204 of the buckle body 210 in hinge knuckles 340 formed on the both sides, in which a push portion 330 protrudes in a movement direction of the band 100 and the holding bent ends 251 of the plate spring 250 are forcibly lifted by axial rotation, thereby releasing a holding state.

The buckle switch 300 includes a pair of bent protrusion ends 310 which protrude from both sides of the front end and are bent to be held by the both holding protrusions 120 of the band 100.

The both bent protrusion ends 310 of the buckle switch 300 are in close contact with the body 110 of the band 100 by the elastic supporting section 252 of the plate spring 250 being in pressurized contact with a bent portion 320 to allow the holding protrusions 120 to restrict the band 100 in sliding.

In embodiments of the present invention, the plate spring 250 is bent due to a concave groove portion 253 in a center thereof to allow the axial pin 350 to pass therethrough without interference, the buckle switch 300 is axially coupled with the hinge knuckles 340 which are disposed above the concave groove portion 253 through hinge-coupling due to the axial pin 350, and the push portion 330 of the buckle switch 300 is pushed by the elastic supporting section 252 of the plate spring 250 and protrudes while being held by a bottom end surface of the inlet 220.

In embodiments of the present invention described above, a pair of the holding protrusions 120 of the band 100 may be held by the holding bent end 251 of the plate spring 250 and the bent protrusion end 310 of the buckle switch 300 at the same time to be restricted.

Figure 10:
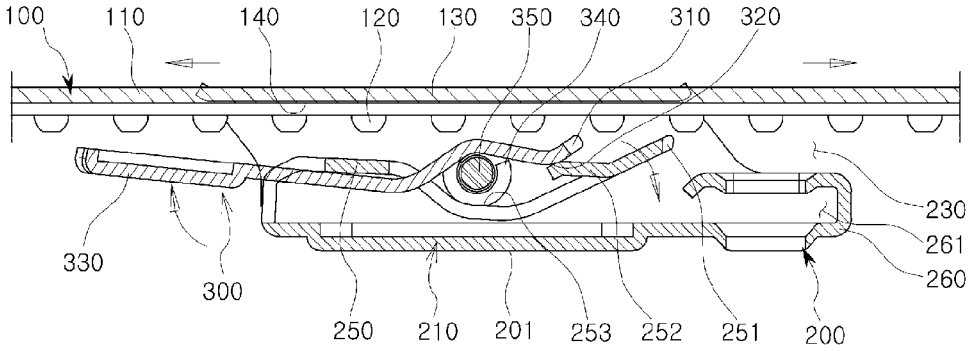
FIG. 10 is a cross-sectional view illustrating an operation of releasing a unified state of the band and the buckle according to embodiments of the present invention.

An operation according to embodiments of the present invention described above will be described as follows with reference to FIG. 10.

In a description of the operation according to embodiments of the present invention, a direction of tightening the band 100 will be referred to as a forward direction and a direction of releasing the band 100 will be referred to as a backward direction.

To tighten the band 100, the band 100 is pulled toward the outlet 230 of the buckle body 210 of the buckle 200. In this case, a pulling force of the band 100 allows the holding protrusions 120 to freely slide while overcoming an applied pressure of the both bent protrusion ends 310 of the buckle switch 300 pressurized by the both holding bent ends 251 formed on the front end of the plate spring 250 and the elastic supporting section 252 of the plate spring 250.

Here, the band 100 is sewn on the attached material P-2 by the sewing groove 140 in the center to maximally shield an exposure of the sewing. Also, the sliding protrusion portion 130 is guided by the guide slot 205 formed on the rear side 202 of the buckle body 210 and simultaneously divided both sides of the rear side 202 slide while being in close contact with each other.

Naturally, the buckle body 210 is provided while being connected to the attached material P-1 due to the fixing portion 260 of the buckle body 210.

When pulling the band 100 backward, a force to allow the holding bent ends 251 of the plate spring 250 and the bent protrusion ends 310 of the buckle switch 300 to penetrate occurs due to an inclination, thereby preventing a separation of the holding protrusions 120 of the band 100 to stop sliding of the band 100.

Accordingly, to release the band 100, the push portion 330 of the buckle switch 300 is pushed and rotated on the axial pin 350.

As the bent protrusion ends 310 are lifted by the rotation of the buckle switch 300 as described above and the bent portion 320 pushes the elastic supporting section 252 of the plate spring 250 and rotates to lift the holding bent ends 251 at the same time to be separated from a height of the holding protrusion 120, thereby allowing the band 100 to slide backward to be released.

As described above, embodiments of the present invention has been described. However, the present invention is not limited to embodiments described above and may have various modifications without departing from the technical scope of the present invention.

For example, the plate spring 250 formed by integrally bend-molding with the buckle body 210 which forms the buckle 200 in embodiments described above may be separately configured from the buckle body 210.

Hereinafter, embodiments of the present invention will be described while like reference numerals indicate like elements.

Figure 11:
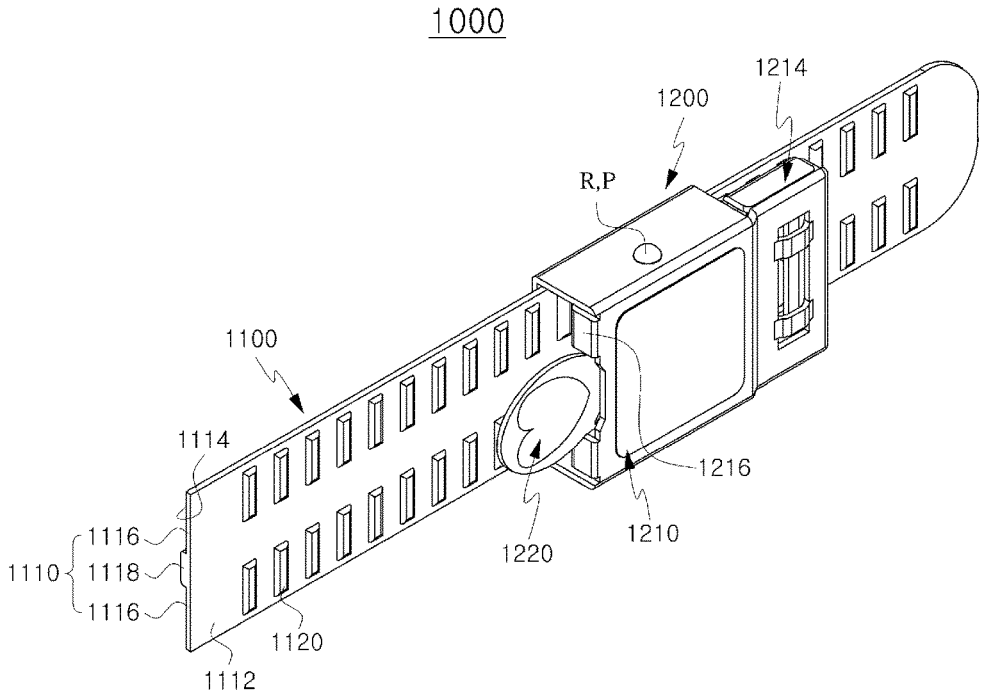
FIG. 11 is a perspective view of a band adjusting device according to an embodiment of the present invention.
Figure 12:
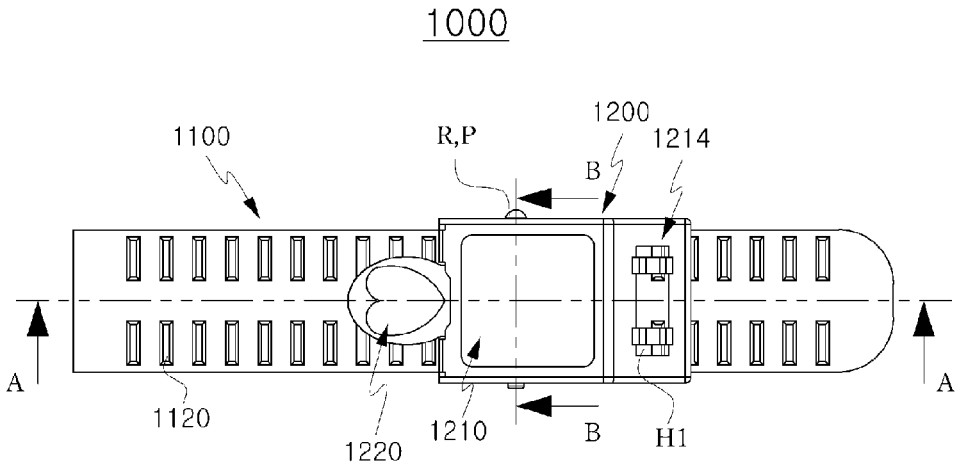
FIG. 12 is a front view of the band adjusting device according to an embodiment of the present invention.

FIG. 11 is a perspective view of a band adjusting device 1000 according to an embodiment of the present invention. FIG. 12 is a front view of the band adjusting device 1000 according to an embodiment of the present invention.

Figure 13A:
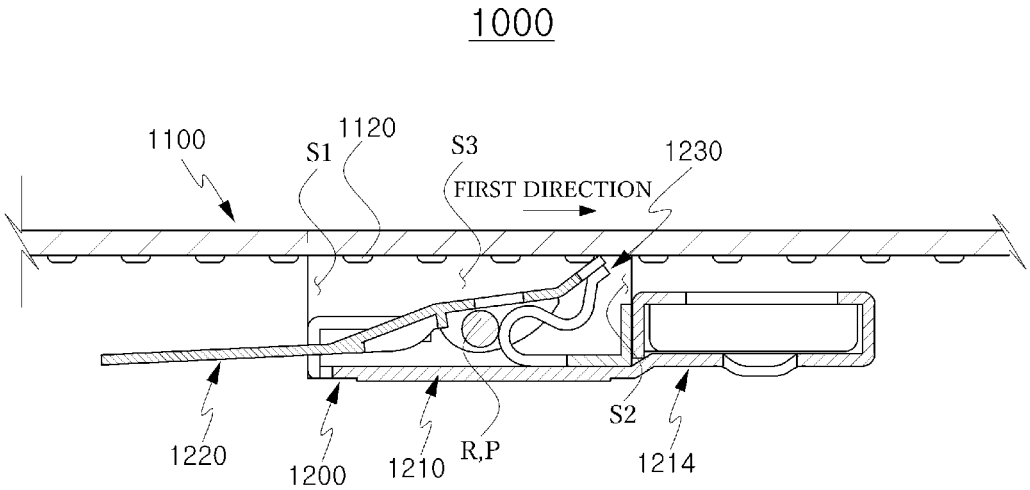
FIGS. 13A and 13B are respective cross-sectional views taken along lines A-A and B-B shown in FIG. 12.
Figure 13B:
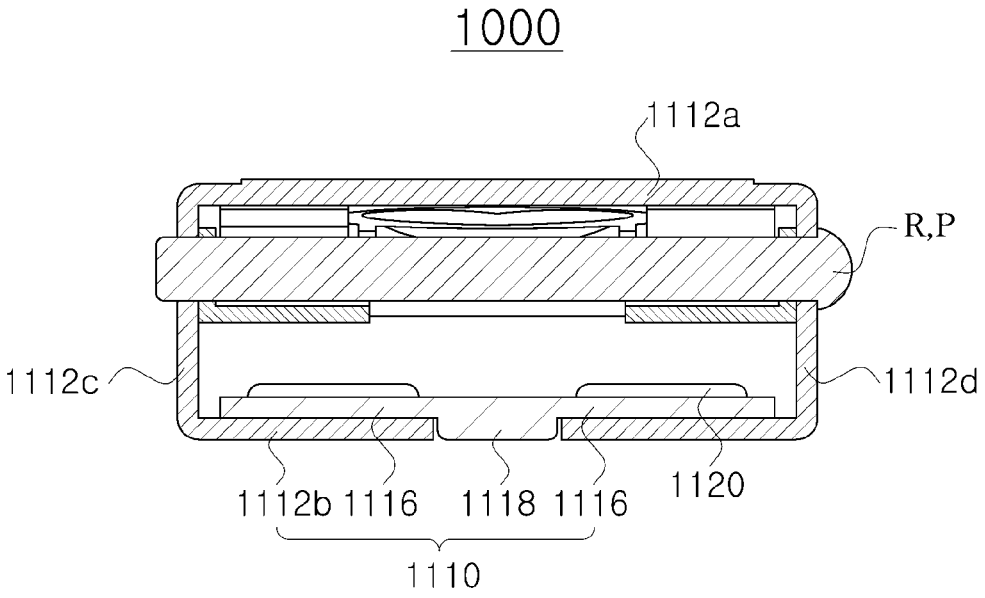
Figure 14A:
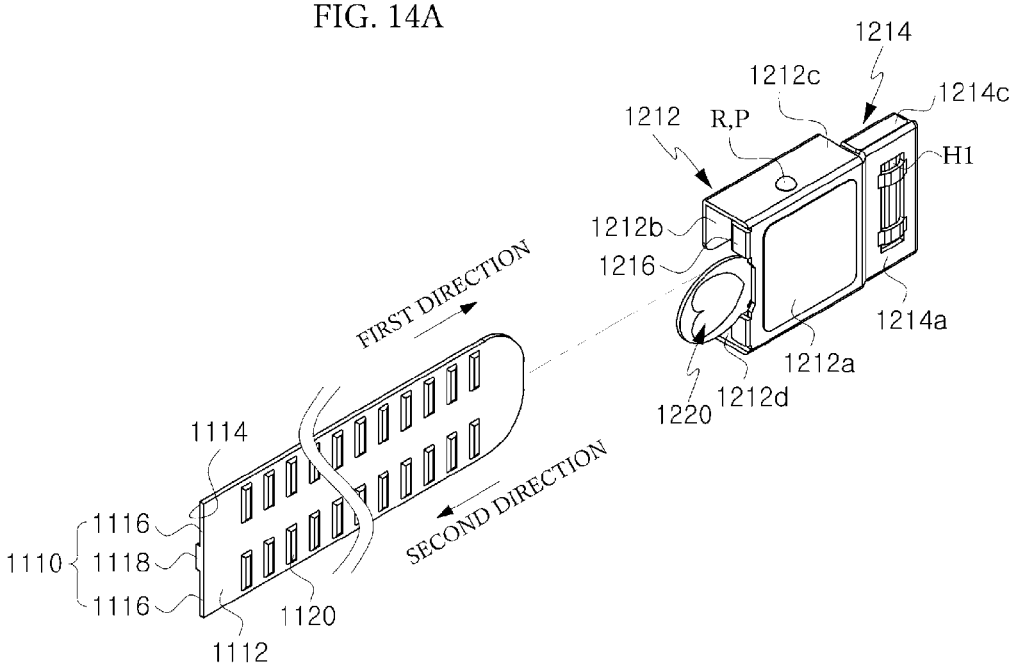
FIGS. 14A and 14B are views of a band and a controller, separated from each other, provided in the band adjusting device according to an embodiment of the present invention.
Figure 14B:
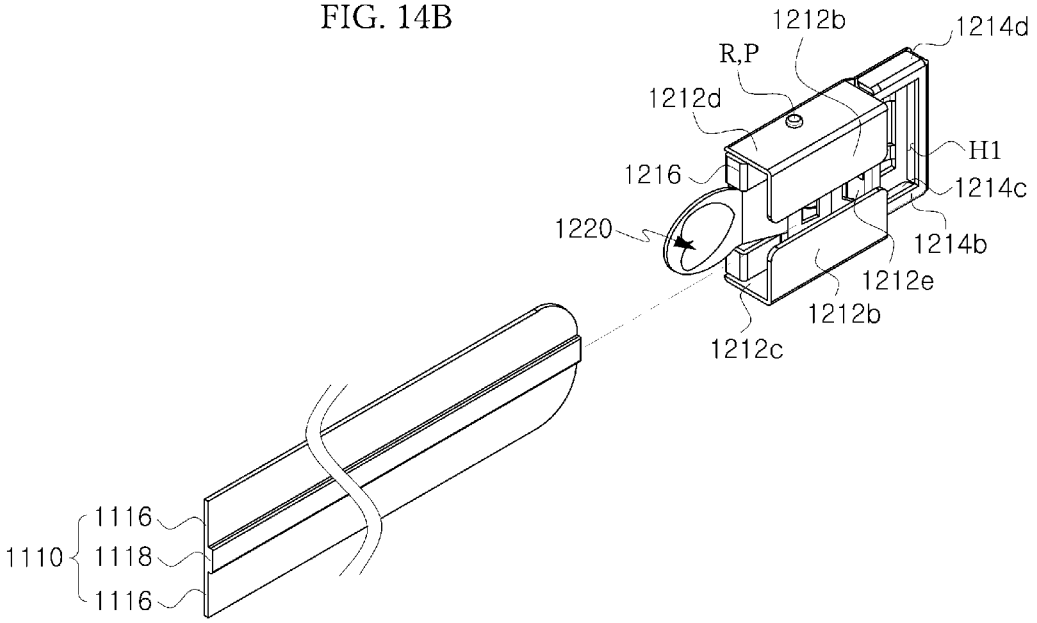
Figure 15A:
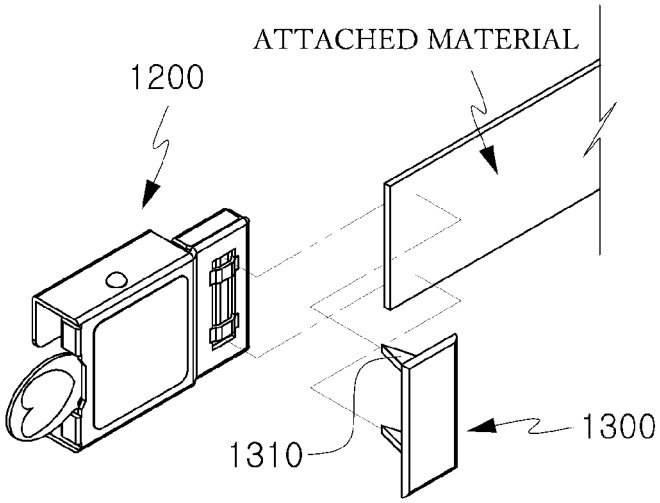
FIGS. 15A to 15C are views illustrating various methods of connecting the controller provided in the band adjusting device with an attached material according to an embodiment of the present invention.
Figure 15B:
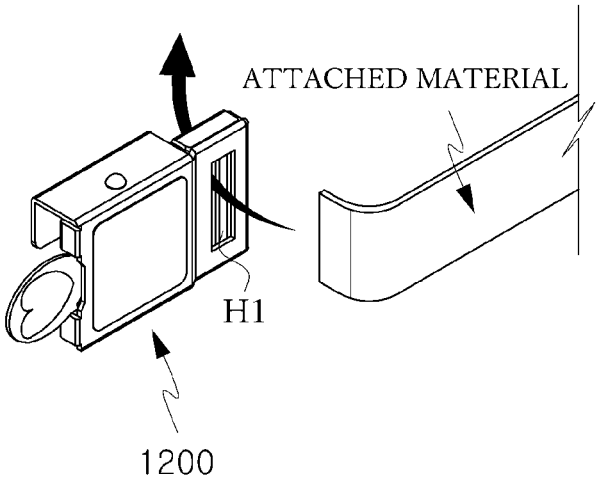
Figure 15C:
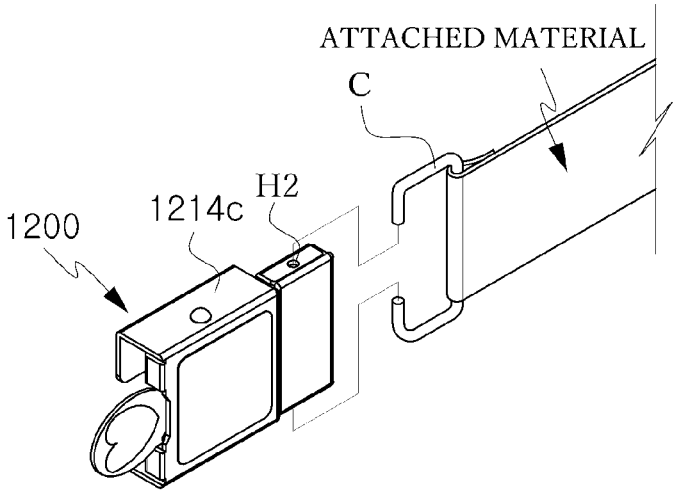

Also, FIGS. 13A and 13B are respective cross-sectional views taken along lines A-A and B-B shown in FIG. 12. FIGS. 14A and 14B are views of a band 1100 and a controller 1200, separated from each other, provided in the band adjusting device according to an embodiment of the present invention. FIGS. 15A to 15C are views illustrating various methods of connecting the controller provided to the band adjusting device with an attached material.

Referring to FIGS. 11 to 15C, the band adjusting device 1000 according to an embodiment of the present invention may include the band 1100 and the controller 1200.

The controller 1200 may be a type of buckle which allows the band 1100 to freely move in a first direction but selectively allows the band 1100 to freely move in a second direction opposite the first direction.

The controller 1200 may include a body portion 1210, a band control portion 1220, and an elastic portion 1230. Schematically, the body portion 1210 may provide an external shape of the controller 1200 and may include an insertion space S1 into which one end of the band 1100 is inserted and a discharge space S2 through which the one end of the band 1100 inserted in the insertion space S1 is discharged.

Also, the band control portion 1220 may be movably mounted in the body portion 1210 between a first position and a second position based on a rotation axis R to allow the band 1100 to freely move in the first direction in the first position while being in contact with the band 1100 and to allow the band 1100 to freely move in the second direction in the second position while being not in contact with the band 1100.

The elastic portion 1230 may be located in an internal space S3 of the body portion 1210 to be immovable in the first direction and the second direction to be elastically deformed when the band control portion 1220 is moved from the first position to the second position due to an external force and to restore the band control portion 1220 from the second position to the first position through a restoring force caused by the elastic deformation when the external force is removed.

Here, the first direction may indicate a direction in which the band 1100 is inserted into the internal space S3 of the body portion 1210 and the second direction may indicate a direction in which the band 1100 located in the internal space S3 is discharged outside the internal space S3 (refer to FIG. 14).

Also, the first position may be a position shown in FIG. 13A in which a movement in the first direction is free but a movement in the second direction is not possible. The second direction is a position shown in FIG. 21 in which a movement of the band 1100 in the second direction is free.

Hereinafter, the components will be described in detail.

The body portion 1210 may include a frame portion 1212 which defines the insertion space S1 and the discharge space S2, an attached material connection portion 1214 which extends from the frame portion 1212 and is connected to an attached material, and a separation-prevention portion 1216 which extends from the frame portion 1212 to be in contact with the band control portion 1220 to prevent a separation of the band control portion 1220 when the band control portion 1220 is located in the second position.

First, the attached material connection portion 1214 is located in the discharge space S2 based on the frame portion 1212 to connect the frame portion 1212 with the attached material and may include a first front wall 1214*a*, a first rear wall 1214*b*, a first top wall 1214*c*, and a first bottom wall 1214*d*.

The first front wall 1214*a*, the first rear wall 1214*b*, the first top wall 1214*c*, and the first bottom wall 1214*d* may be implemented through bend-molding. A connection space H1 may be formed in the first front wall 1214*a* and the first rear wall 1214*b* while penetrating therethrough.

The connection space H1 formed in the first front wall 1214*a* and the first rear wall 1214*b* may be an element to allow the attached material to be connected through the first front wall 1214*a* and the first rear wall 1214*b*.

In detail, the connection space H1 formed in the first front wall 1214*a* may be a space into which a pointed portion 1310 of a fixing pin 1300, which connects the attached material connection portion 1214 with the attached material is inserted after passing through the attached material and the connection space H1 formed in the first rear wall 1214*b* may be a space into which an additional caulking jig for caulking the pointed portion 1310 which passes through the connection space H1 formed in the first front wall 1214*a* is inserted (refer to FIG. 14B).

Here, the first front wall 1214*a* and the first rear wall 1214*b* may provide a space into which the caulking jig is inserted and may be means for implementing a modified method of connecting the attached material (refer to FIGS. 15B and 15C), which will be described below.

Meanwhile, when the fixing pin 1300 is mounted in the attached material connection portion 1214, a space between the first front wall 1214*a* and the first rear wall 1214*b* may be closed using an additional member.

Meanwhile, the number of connection spaces H1 formed in the first front wall 1214*a* may vary according to the number of pointed portions 1310 of the fixing pin 1300. Also, a shape of the connection space H1 formed in the first front wall 1214*a* and the first rear wall 1214*b* may vary when the attached material connection portion 1214 and the attached material are connected to each other using another method in addition to using the fixing pin 1300.

For example, referring to FIG. 15B, the connection space H1 formed in the first front wall 1214*a* and the connection space H1 formed in the first rear wall 1214*b* may have approximately identical shapes and may be a single one. The attached material connection portion 1214 and the attached material may be connected by inserting the attached material into the connection space H1 as described above.

Meanwhile, referring to FIG. 15C, unlike FIGS. 15A and 15B, the connection space H1 may not be formed in the first front wall 1214*a* and the first rear wall 1214*b* but a connection space H2 may be formed in the first top wall 1214*c* and the first bottom wall 1214*d* while passing therethrough.

This is a case in which connection between the attached material connection portion 1214 and the attached material is implemented through the first top wall 1214*c* and the first bottom wall 1214*d* using a clip C or a pin C.

As a result, the connection space H2 formed in the first top wall 1214*c* and the first bottom wall 1214*d* may be an element to allow the attached material to be connected through the first top wall 1214*c* and the first bottom wall 1214*d*.

In the above, it has been described that the connection space H1 which may be formed in the first front wall 1214*a* and the first rear wall 1214*b* or the connection space H2 which may be formed in the first top wall 1214*c* and the first bottom wall 1214*d* pass therethrough. However, the connection spaces H1 and H2 are not limited thereto but may be provided as a type of groove which is formed by being depressed instead of being passed through.

Meanwhile, the attached material connection portion 1214 may be located in the rear based on the frame portion 1212 to prevent the attached material from protruding further than the frame portion 1212 when the attached material connection portion 1214 is connected with the attached material, which may be implemented through bend-molding.

The attached material connection portion 1214 is located in the rear based on the frame portion 1212 to allow the fixing pin 1300 described above to be located on the same plane with the frame portion 1212, in which even though the attached material connection portion 1214 protrudes further than the frame portion 1212, a degree of protruding may be minimized.

Meanwhile, the frame portion 1212 may include a second front wall 1212*a*, a second rear wall 1212*b*, and a second top wall 1212*c*, which define the internal space S3, and a discharge-space-defining wall 1212*e* which defines the discharge space S2 according to a relationship with the second rear wall 1212*b*.

Here, the discharge-space-defining wall 1212*e* may be an inner wall of the attached material connection portion 1214 or may be a side wall formed by being bent from the second front wall 1212*a* or the second rear wall 1212*b* when the attached material connection portion 1214 is omitted, that is, the attached material is directly connected to the frame portion 1212.

The band control portion 1220 is a component rotatably mounted on a penetration pin P which is a rotation axis R passing through the second top wall 1212*c* and a second bottom wall 1212*d* to selectively allow the band 1100 to move in a second direction and may be a type of buckle switch.

The band control portion 1220 may be located in the first position due to an elastic force of the elastic portion 1230 when an external force is not applied and may be moved to a second position while elastically deforming the elastic portion 1230 when the external force is applied.

Here, the elastic portion 1230 may be in contact with the body portion 1210, that is, the discharge-space-defining wall 1212*e*, so as not to be moved in the first direction in the internal space S3 of the body portion 1210 and may be in contact with the penetration pin P that is the rotation axis so as not to be moved in the second direction.

Due thereto, the elastic portion 1230 may be stably disposed in the internal space S3.

Meanwhile, the band 1100 may include a body portion 1110 which includes a front side 1112 and a rear side 1114 and has a certain length and a hold portion 1120 which is formed on the body portion 1110 and extends in a vertical direction of the front side 1112 to allow the band control portion 1220 to be held when the body portion 1110 moves in the second direction.

Here, the body portion 1110 may include a pair of wing portions 1116 inserted into the insertion space S3 provided by the body portion 1210 and a supporting portion 1118 which connects the pair of wing portions 1116 and supports the pair of wing portions 1116 while protruding in a longitudinal direction toward a rear side surface and sliding through the second rear wall 1212*b* of the body portion 1210.

Also, the hold portion 1120 may be formed on each of the pair of wing portion 1116 symmetrically based on the supporting portion 1118.

The hold portion 1120 may have a shape protruding from the front side 1112 of the body portion 1110. When the band control portion 1220 is located in the first position, an end of the band control portion 1220 is held by the hold portion 1120, thereby preventing a movement of the body portion 1110 in the second direction.

Meanwhile, when the body portion 1110 is inserted into the internal space S3, the pair of wing portions 1116 may slide while being in contact with an inner surface of the second rear wall 1212*b* and the supporting portion 1118 may slide through the second rear wall 1212*b*.

Figure 16:
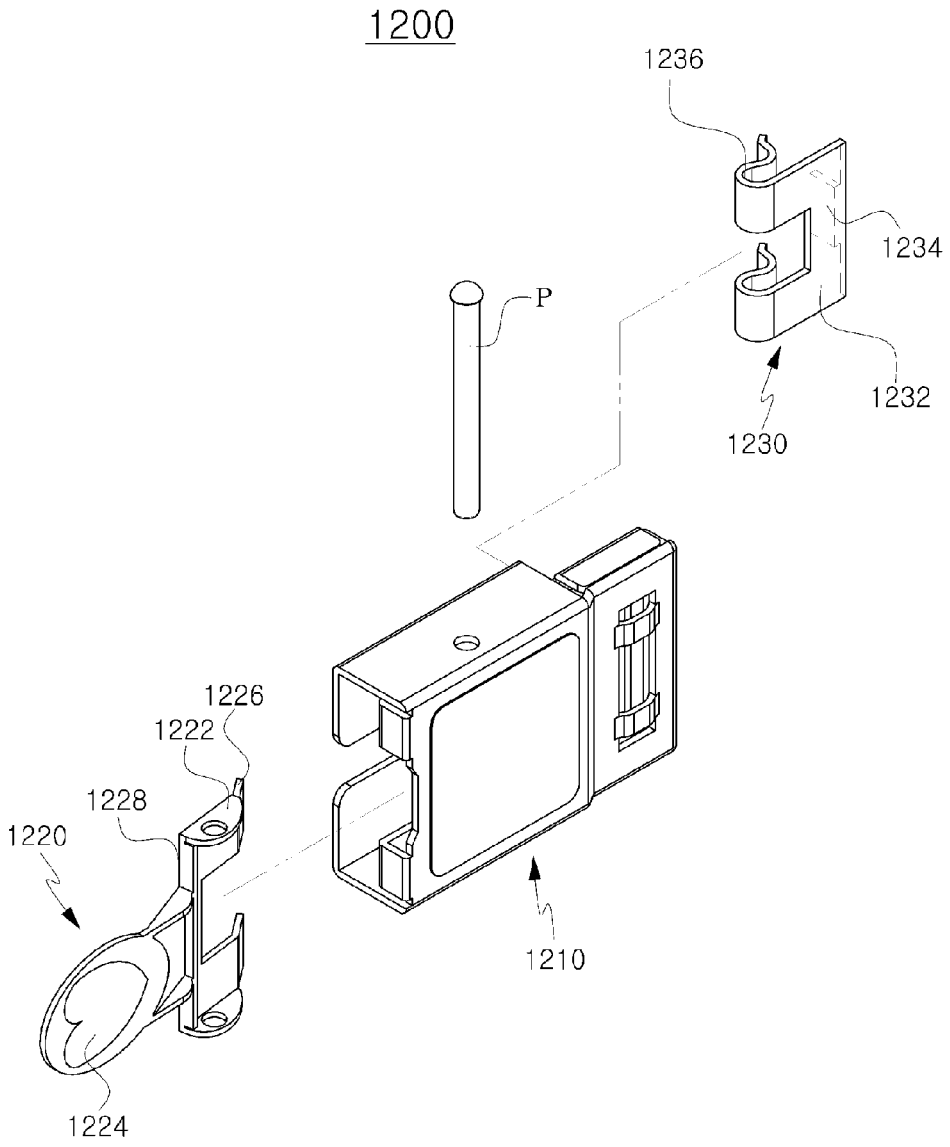
FIG. 16 is an exploded view of the controller provided in the band adjusting device according to an embodiment of the present invention.

FIG. 16 is an exploded view of the controller 1200 provided in the band adjusting device 1000 according to an embodiment of the present invention.

Referring to FIG. 16, the controller 1200 provided in the band adjusting device 1000 according to an embodiment of the present invention may include the body portion 1210, the band control portion 1220, and the elastic portion 1230.

The band control portion 1220 may include a rotation implementation portion 1222 which allows rotation about the penetration pin P that is the rotation axis R to allow a mutual change between the first position and the second position.

In detail, the band control portion 1220 may include an external force receiving portion 1224 which receives an external force to allow the band 1100 to move in the second direction, a holding portion 1226 which interconnects with the external force receiving portion 1224 and is released from the band 1100 by the external force, and a connection portion 1228 which connects the external force receiving portion 1224, the holding portion 1226, and the rotation implementation portion 1222 with one another.

Here, the rotation implementation portion 1222 may extend from the connection portion 1228 at a certain angle, thereby minimizing a ratio of a portion occupied by the rotation implementation portion 1222 to the internal space S3.

The rotation implementation portion 1222 may be formed through being bent from the connection portion 1228 but is not limited thereto and may be implemented using other methods other than the bending method depending on a manufacturing method.

Meanwhile, the elastic portion 1230 may include a mounting portion 1232 which is mounted on the second front wall 1212*a*, a restriction portion 1234 which extends from the mounting portion 1232 and is in contact with the discharge-space-defining wall 1212*e* to restrict a change in position in the first direction, and an elastic deformation portion 1236 which extends from the mounting portion 1232 to be elastically deformed by the change in position of the band control portion 1220.

The restriction portion 1234 and the elastic deformation portion 1236 may be formed through being bent from the mounting portion 1232. A boundary between the mounting portion 1232 and the elastic deformation portion 1236 may be in contact with the penetration pin P that is the rotation axis R and may be restricted in moving in the second direction in the internal space S3.

Figure 17A:
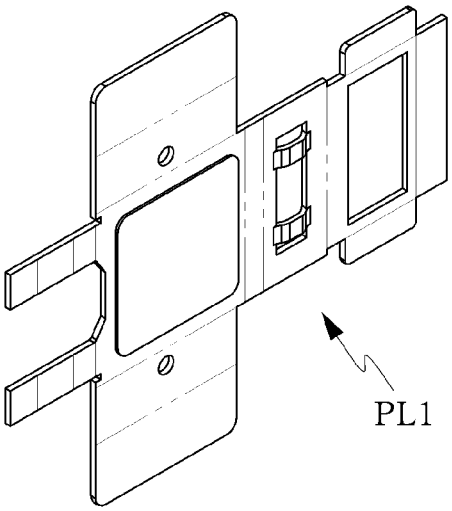
FIGS. 17A, 17B, and 17C are perspective views illustrating pre-manufacturing states of a body portion, a band control portion, and an elastic portion to be provided to the controller shown in FIG. 16, respectively.
Figure 17B:
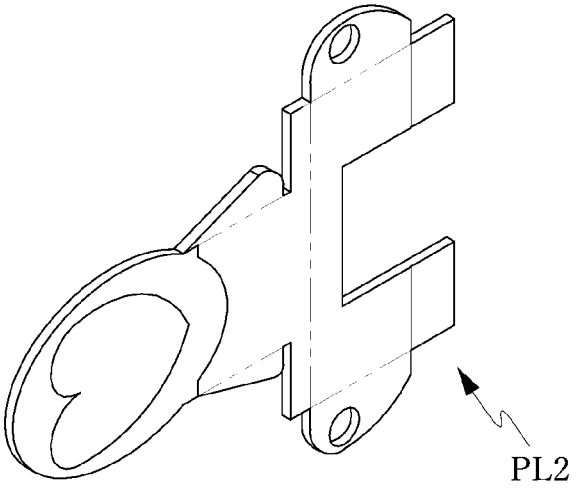
Figure 17C:
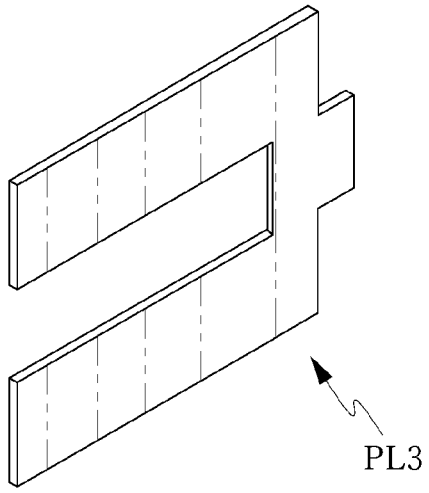
Figure 18A:
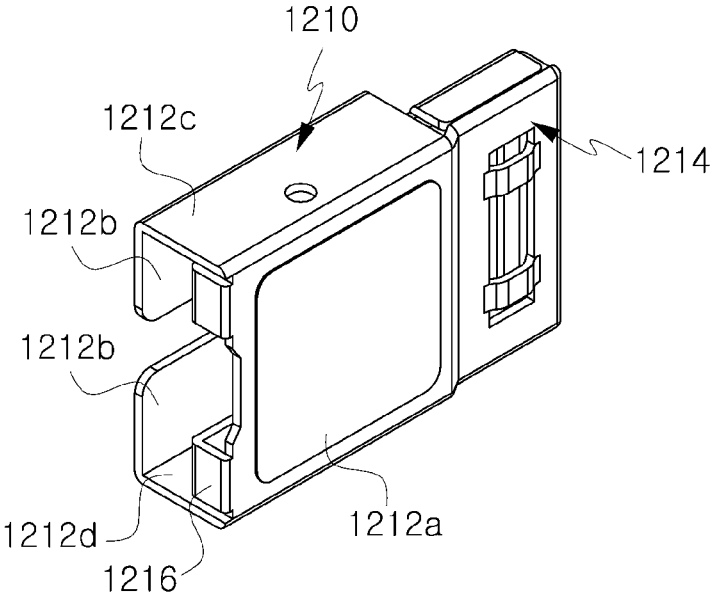
FIGS. 18A, 18B, and 18C are perspective views illustrating processes of manufacturing the body portion, the band control portion, and the elastic portion to be provided to the controller shown in FIG. 16, respectively.
Figure 18B:
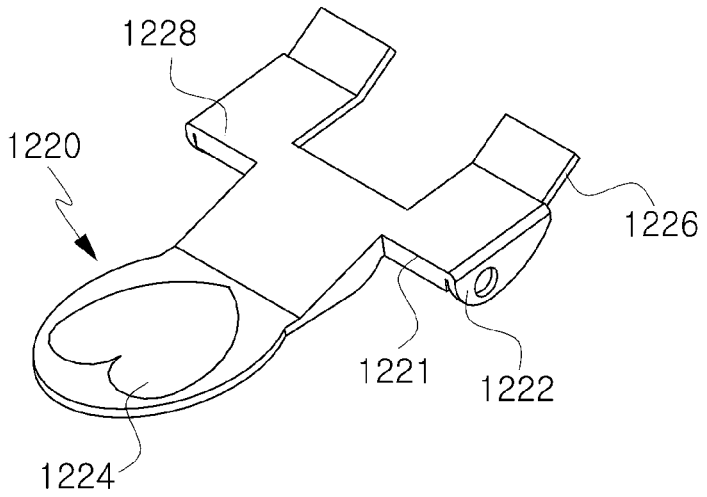
Figure 18C:
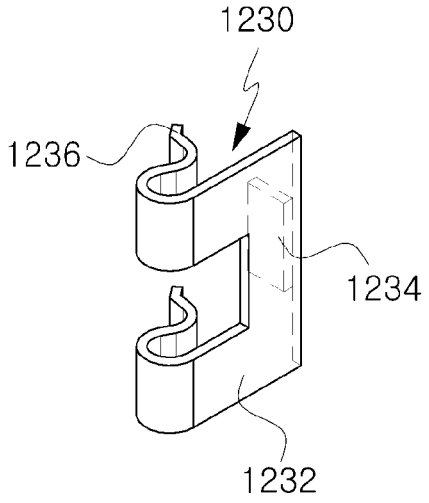

FIGS. 17A, 17B, and 17C are perspective views illustrating pre-manufacturing states of the body portion 1210, the band control portion 1220, and the elastic portion 1230 to be provided to the controller 1200 shown in FIG. 16, respectively. FIGS. 18A, 18B, and 18C are perspective views illustrating processes of manufacturing the body portion 1210, the band control portion 1220, and the elastic portion 1230 to be provided to the controller 1200 shown in FIG. 16, respectively.

First, referring to FIG. 17A, a metal plate PL1 formed by sheeting is processed through a bending process to form the body portion 1210 which includes the second front wall 1212*a*, a pair of second rear walls 1212*b*, the second top wall 1212*c*, and the second bottom wall 1212*d* as shown in FIG. 18A. Additionally, the separation-prevention portion 1216 may be formed to be in contact with the band control portion 1220 to prevent a separation of the band control portion 1220 when the attached material connection portion 1214 and the band control portion 1220 which are connected to the body portion 1210 are located in the first position or the second position.

The separation-prevention portion 1216 may be in contact with the band control portion 1220 when the band control portion 1220 is located in the first position. Accordingly, a supporting load caused by an external force which may be applied to the band 1100 when the band control portion 1220 is located in the first position may be maximized, thereby preventing a damage of the rotation axis R.

Also, when the band control portion 1220 is mounted in the body portion 1210, the separation-prevention portion 1216 may guide the band control portion 1220 to be mounted.

Next, referring to FIG. 17B, a metal plate PL2 formed by sheeting is processed through a bending process as shown in FIG. 18B to form the band control portion 1220 which includes the external force receiving portion 1224 which receives the external force to allow the band 1100 to move in the second direction, the holding portion 1226 which interconnects with the external force receiving portion 1224 and is released from the band 1100 by the external force, and the connection portion 1228 which connects the external force receiving portion 1224, the holding portion 1226, and the rotation implementation portion 1222 to one another.

Here, unlike the drawings, the connection portion 1228 may be formed to be rounded from the external force receiving portion 1224. In other words, a part indicated by a reference numeral 1221 may be formed to be rounded.

Since the part indicated by the reference numeral 1221 is formed to be rounded, a contact with the hold portion 1120 of the band 1100, which may occur when the band control portion 1220 changes in position based on the rotation axis R may be prevented beforehand.

In detail, when the connection portion 1228 is formed to be rounded from the external force receiving portion 1224, a distance between an end of the part indicated by the reference numeral 1221 and the rotation axis R becomes smaller. In this case, a turning radius of the end may become smaller when the band control portion 1220 changes in position.

Accordingly, interference between the connection portion 1228 and the band 1100, which may occur in minimizing the body portion 1210, may be prevented beforehand.

Next, referring to FIG. 17C, a metal plate PL3 formed by sheeting is processed through a bending process as shown in FIG. 18C to form the elastic portion 1230 which includes the mounting portion 1232 which is mounted on the second front wall 1212*a*, the restriction portion 1234 (refer to FIG. 20) which extends from the mounting portion 1232 and is in contact with the discharge-space-defining wall 1212*e* to restrict a change in position in the first direction, and the elastic deformation portion 1236 which extends from the mounting portion 1232 to be elastically deformed by the change in position of the band control portion 1220.

Here, the elastic deformation portion 1236 may be formed to be rounded from the mounting portion 1232 to have an approximate S shape in such a way that a load is distributed while the elastic deformation portion 1236 is repetitively and elastically deformed according to the change in position of the band control portion 1220, thereby preventing a reduction in restoring force.

However, the elastic deformation portion 1236 does not need to be rounded and may be formed to be straight.

Meanwhile, the boundary between the mounting portion 1232 and the elastic deformation portion 1236 is formed to be rounded to increase a contact area with the penetration pin P which is the rotation axis R, thereby effectively preventing the movement of the elastic portion 1230 in the second direction.

Meanwhile, it should be known that the elastic portion 1230 may be implemented as a pair thereof while the elastic deformation portion 1236 is separated.

Figure 19:
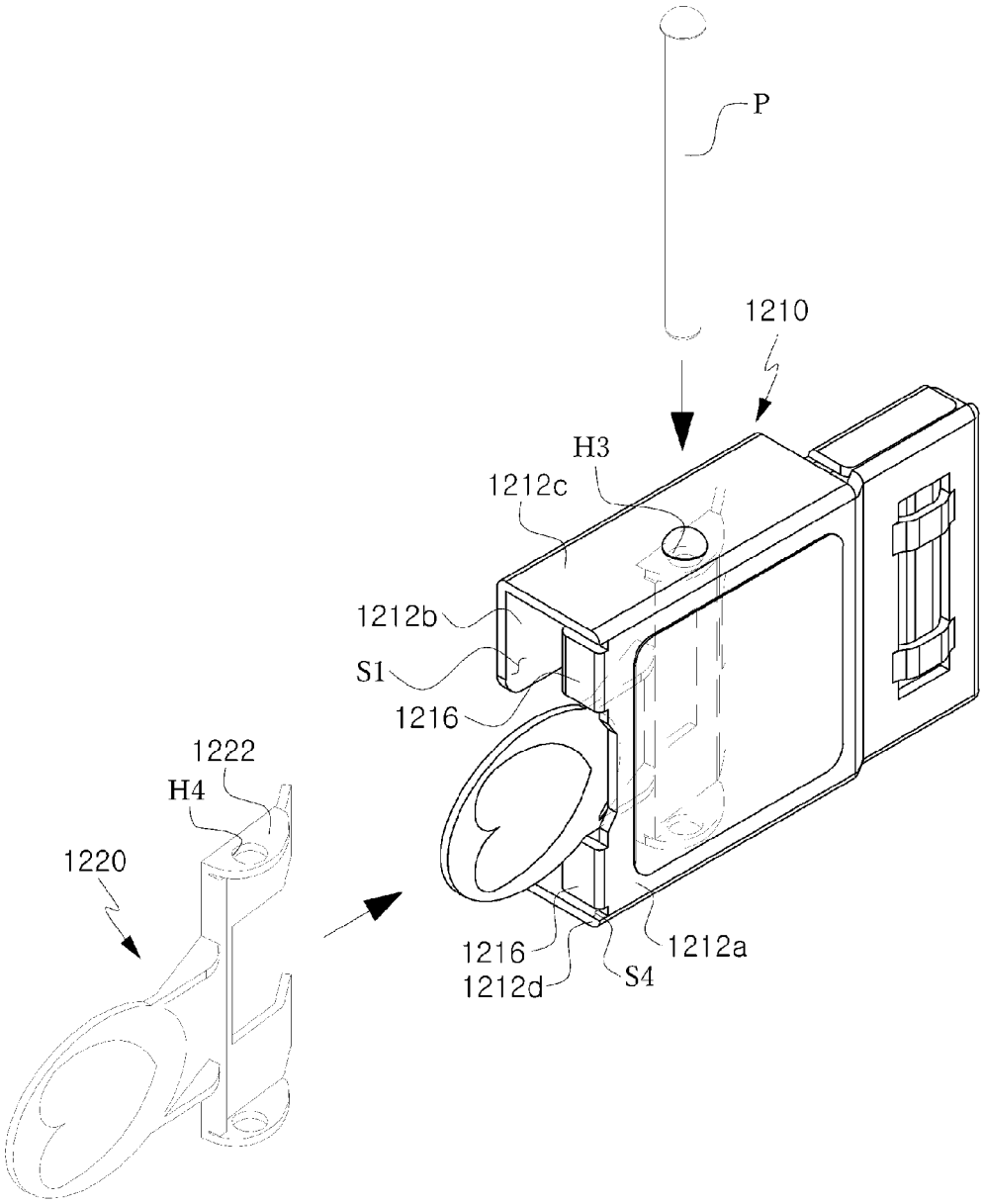
FIG. 19 is a perspective view illustrating a process of mounting the band control portion in the body portion provided in the controller shown in FIG. 16.
Figure 20:
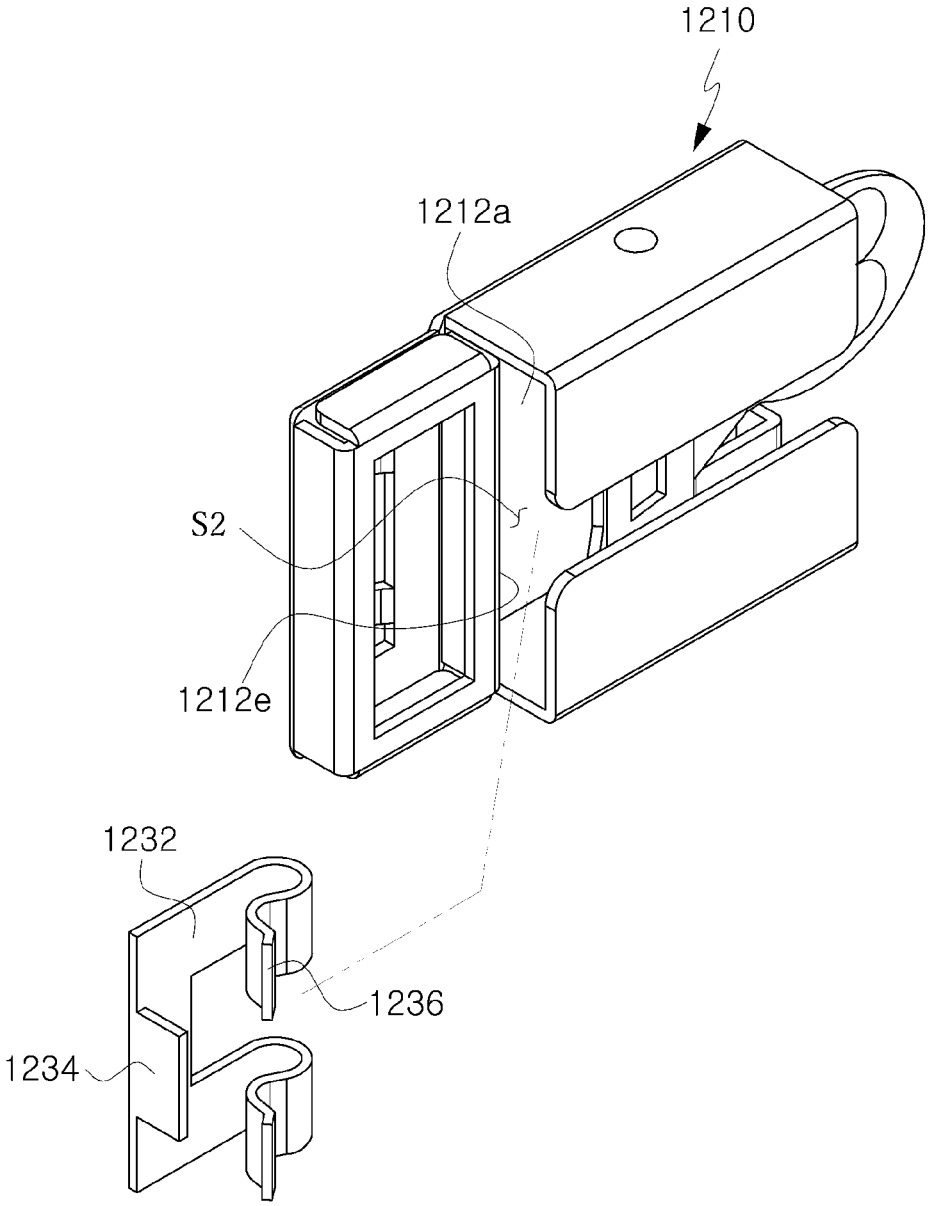
FIG. 20 is a perspective view illustrating a process of inserting the elastic portion in a state shown in FIG. 19.

FIG. 19 is a perspective view illustrating a process of mounting the band control portion 1220 in the body portion 1210 provided in the controller 1200 shown in FIG. 16. FIG. 20 is a perspective view illustrating a process of inserting the elastic portion 1230 in a state shown in FIG. 19.

Referring to FIG. 19, the band control portion 1220 manufactured by the method shown in FIGS. 17B and 18B is inserted into the internal space S3 of the body portion 1210 manufactured by the method shown in FIGS. 17A and 18A.

Here, a direction of inserting the band control portion 1220 may be a direction from the outside toward the insertion space S1 and the rotation implementation portion 1222 of the band control portion 1220 may pass through a through space S4 having a certain size formed between the separation-prevention portion 1216 and the second top wall 1212*c* and a through space S4 having a certain size formed between the separation-prevention portion 1216 and the second bottom wall 1212*d*.

A width of the through space S4 may be formed to be identical to or slightly greater than a thickness of the rotation implementation portion 1222. Due to the through space S4, a thickness of the body portion 1210, that is, a distance between the second front wall 1212*a* and the second rear wall 1212*b* may be minimized.

In other words, when the through space S4 is not present, since it is necessary for the rotation implementation portion 1222 to be inserted into the internal space S3 through a gap between the separation-prevention portion 1216 and the second rear wall 1212*b*, the thickness of the body portion 1210 may become greater by as much as a thickness thereof.

When the band control portion 1220 is disposed in a certain position in the internal space S3 through the insertion space S1, the penetration pin P passes through a hole H3 formed in the body portion 1210 and an insertion hole H4 of the rotation implementation portion 1222 to allow the rotation implementation portion 1222 to be mounted to be rotatable about the penetration pin P that is the rotation axis R.

Here, the penetration pin P is not limited to being singularly implemented as shown in the drawings but may be separately implemented, which may be selected by one of ordinary skill in the art.

Referring to FIG. 20, when the mounting of the band control portion 1220 in the body portion 1210 is completed, the elastic portion 1230 manufactured as shown in FIGS. 17C and 18C is inserted.

Here, the elastic portion 1230 may be inserted after the band control portion 1220 is in a second position state and an insertion direction may be a direction from the outside toward the discharge space S2.

When the elastic portion 1230 is inserted through the discharge space S2, the mounting portion 1232 is naturally mounted on the second front wall 1212*a* and the elastic deformation portion 1236 bent from the mounting portion 1232 to be rounded or the boundary between the mounting portion 1232 and the elastic deformation portion 1236 is in contact with the penetration pin P that is the rotation axis R, thereby restricting further insertion.

Meanwhile, the restriction portion 1234 is to be in contact with the discharge-space-defining wall 1212*e* to restrict a movement in position in the first direction.

Here, the restriction portion 1234 may be formed in an approximate central portion to be smaller than a width of the mounting portion 1232. Due to this, interference with an end of the holding portion 1226 or an end of the elastic deformation portion 1236, which may occur when the band control portion 1220 is moved from the first position to the second position, may be prevented beforehand.

Meanwhile, the restriction portion 1234 may be bent to be vertical to the mounting portion 1232 but is not limited thereto and may be bent to incline.

Figure 21:
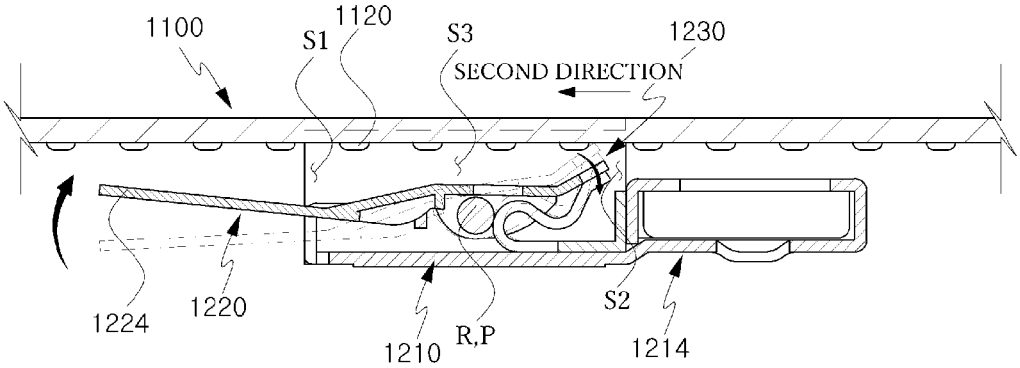
FIG. 21 is a cross-sectional view illustrating a principle by which the band is moved from the body portion provided in the band adjusting device according to an embodiment of the present invention.

FIG. 21 is a cross-sectional view illustrating a principle by which the band 1100 is moved from the body portion 1210 provided in the band adjusting device 1000 according to an embodiment of the present invention.

First, referring to FIG. 13A, a process in which the band 1100 is moved in the first direction and is inserted into the internal space S3 of the body portion 1210 will be described.

The band control portion 1220 may be pressurized by an elastic force of the elastic deformation portion 1236 of the elastic portion 1230 to be located in a first position state. When a user applies an external force to the band 1100 from the insertion space S1 toward the discharge space S2, the hold portion 1120 which protrudes from the body portion 1110 of the band 1100 is to be in contact with the holding portion 1226 of the elastic portion 1230 but is moved in the first direction while slightly moving the holding portion 1226 toward the second position.

Next, referring to FIG. 21, a process in which the band 1100 is moved in the second direction and is inserted into the internal space S3 of the body portion 1210 will be described.

When the band control portion 1220 is located in the first position, even though the user applies the external force to the band 1100 from the discharge space S2 toward the insertion space S1, the hold portion 1120 is held by the holding portion 1226 of the band control portion 1220, the band 1100 is not allowed to move in the second direction.

Here, as shown in FIG. 21, when the external force is applied to the external force receiving portion 1224, the band control portion 1220 rotates about the penetration pin P that is the rotation axis R while elastically deforming the elastic deformation portion 1236 and is moved from the first position to the second position. When the band control portion 1220 is located in the second position, the holding portion 1226 may not be in contact with the hold portion 1120, thereby allowing the band 1100 to move in the second direction.

Meanwhile, when the band control portion 1220 is located in the first position, contact between the band control portion 1220 and the elastic portion 1230 may be implemented only at the holding portion 1226, thereby stably providing elastic deformation of the elastic portion 1230 according to the change of the band control portion 1220 in position.

Also, due to the rounded elastic deformation portion 1236, the load may be effectively distributed, thereby preventing a reduction in the restoring force, which may occur during the repetitive elastic deformation, beforehand. Meanwhile, the restriction portion 1234 of the elastic portion 1230 may be formed in an approximate central portion to be smaller than the width of the mounting portion 1232. Due to this, the interference with the end of the holding portion 1226 or the end of the elastic deformation portion 1236, which may occur when the band control portion 1220 is moved from the first position to the second position, may be prevented beforehand.

Figure 22:
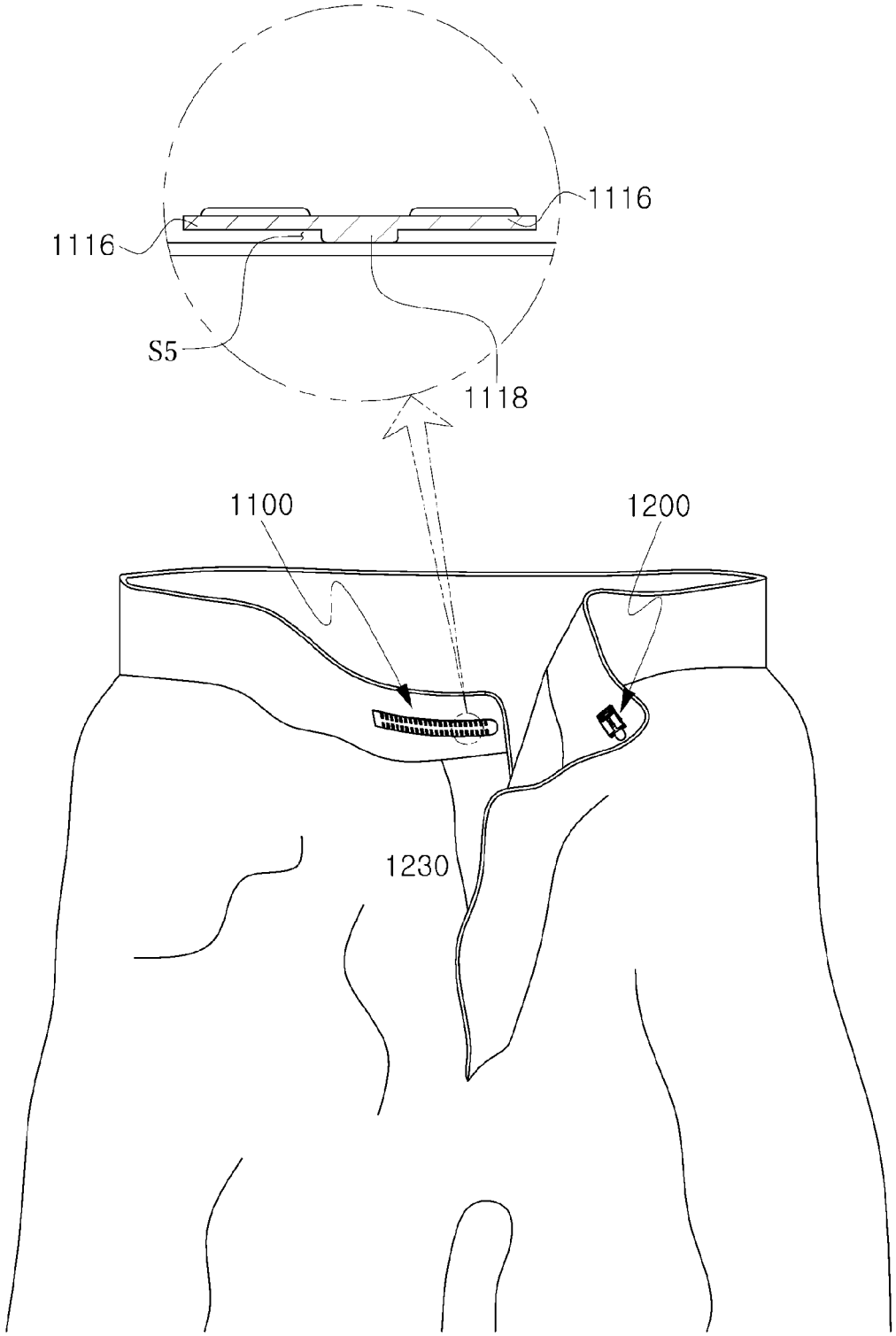
FIG. 22 is a view illustrating a first example of using the band adjusting device according to an embodiment of the present invention.

FIG. 22 is a view illustrating a first example of using the band adjusting device 1000 according to an embodiment of the present invention.

Referring to FIG. 22, the band adjusting device 1000, which has been described with reference to FIGS. 1 to 21, is applied to pants.

The controller 1200 may be attached to one end of a waist part of the pants, and the band 1100 may be attached to the other end thereof.

Here, the one end of the waist part of the pants may be connected to the attached material connection portion 1214 of the controller 1200 by the fixing pin 1300 and the other end thereof may be connected with one side of the supporting portion 1118 of the band 1100 by adhering using adhesives or sewing using thread.

Between the other end and the pair of wing portions 1116 of the band 1100, a separation space S5 as large as a thickness of the supporting portion 1118 may be formed. The separation space S5 may be a space into which the second rear wall 1212*b* of the body portion 1210 is inserted while the band 1100 is inserted into the internal space S3 of the body portion 1210 of the controller 1200.

Figure 23:
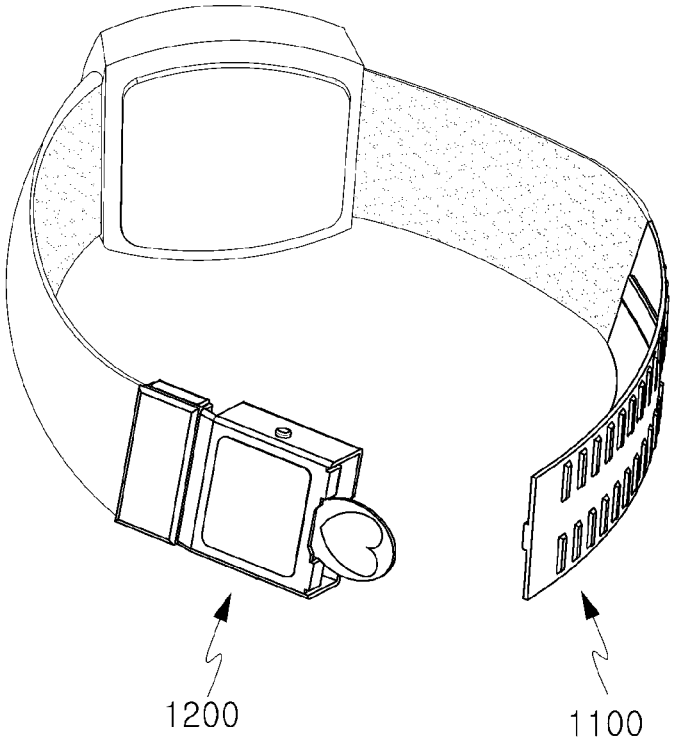
FIGS. 23 and 24 are views illustrating a second example and a third example of using the band adjusting device according to an embodiment of the present invention, respectively.
Figure 24:
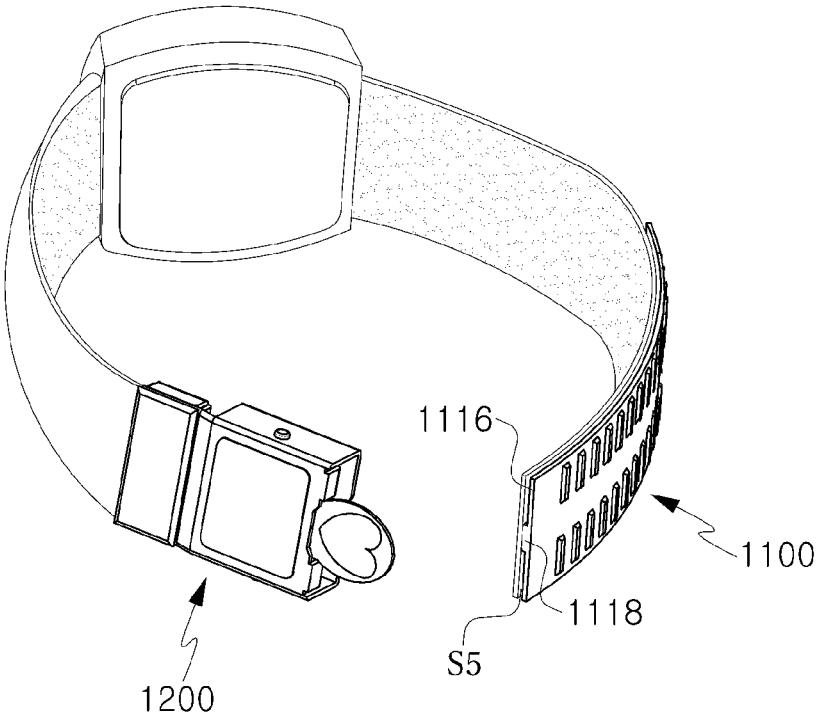

FIGS. 23 and 24 are views illustrating a second example and a third example of using the band adjusting device 1000 according to an embodiment of the present invention, respectively.

Referring to FIGS. 23 and 24, the band adjusting device 1000, which has been described with reference to FIGS. 1 to 21, is applied to a watch.

The controller 1200 may be attached to one end of a watch strap of the watch, and the band 1100 may be attached to the other end thereof.

Here, the other end of the watch strap is connected to one side of the band 1100 in FIG. 23 and the other end of the watch strap is connected to the band 1100 using the method which has been described with reference to FIG. 22.

Referring to FIG. 24, in a part of the watch strap, which is connected to the supporting portion 1118 of the band 1100, the separation space S5 as large as the thickness of the supporting portion 1118 may be formed. The separation space S5 may be the space into which the second rear wall 1212*b* of the body portion 1210 is inserted when the band 1100 is inserted into the internal space S3 of the body portion 1210 of the controller 1200.

Here, the band 1100 and the watch strap connected to the band 1100 may be modularized. In this case, the watch strap connected to the supporting portion 1118 of the band 1100 may be one component of the band 1100, that is, may be defined as a body connection portion connected to the supporting portion 1118 while being separated from the pair of wing portions 1116 to provide the separation space S5 into which the second rear wall 1212*b* of the body portion 1210.

Figure 25A:
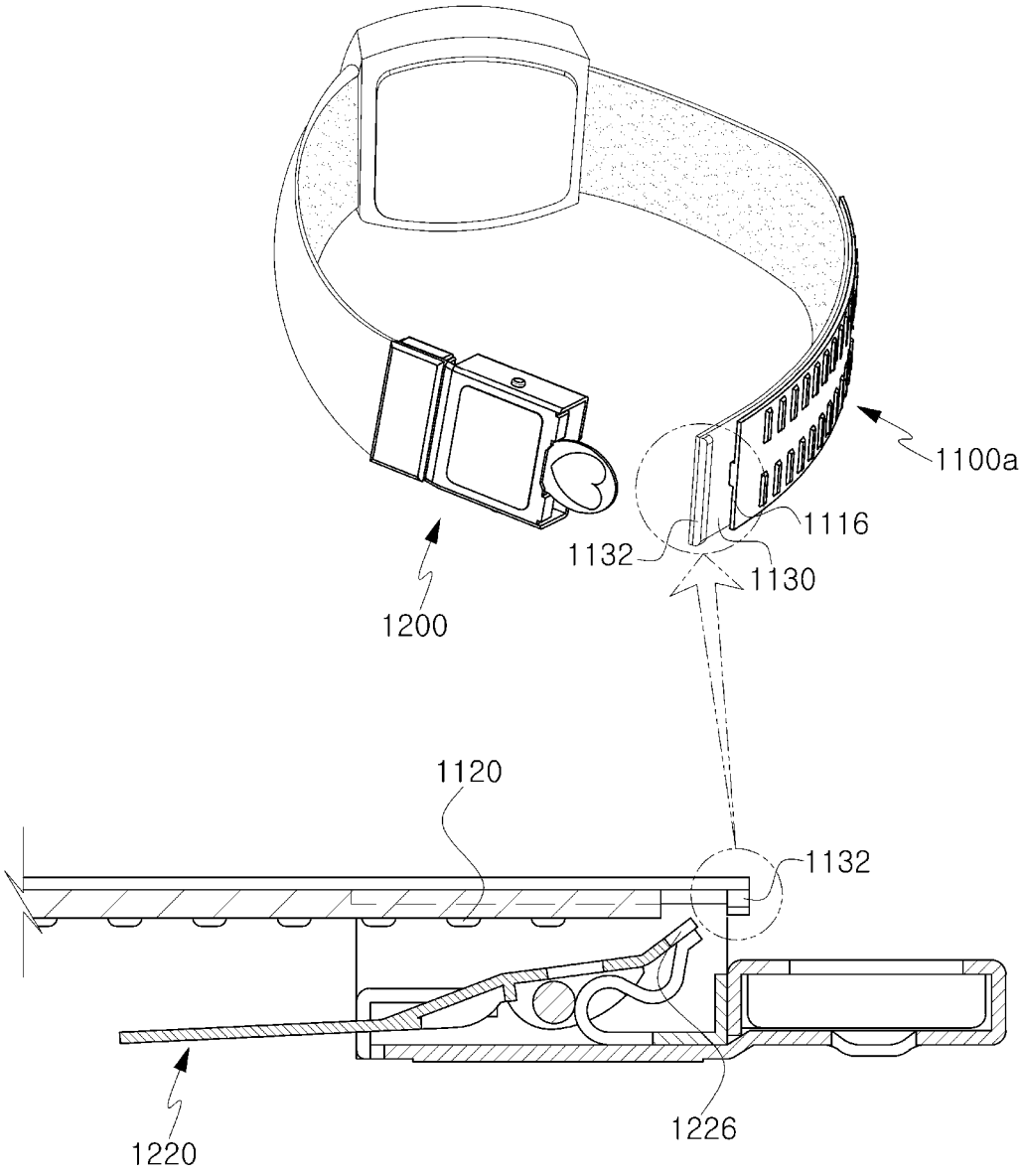
FIGS. 25A and 25B are views illustrating a modified example of the band which has been described with reference to FIG. 24.
Figure 25B:
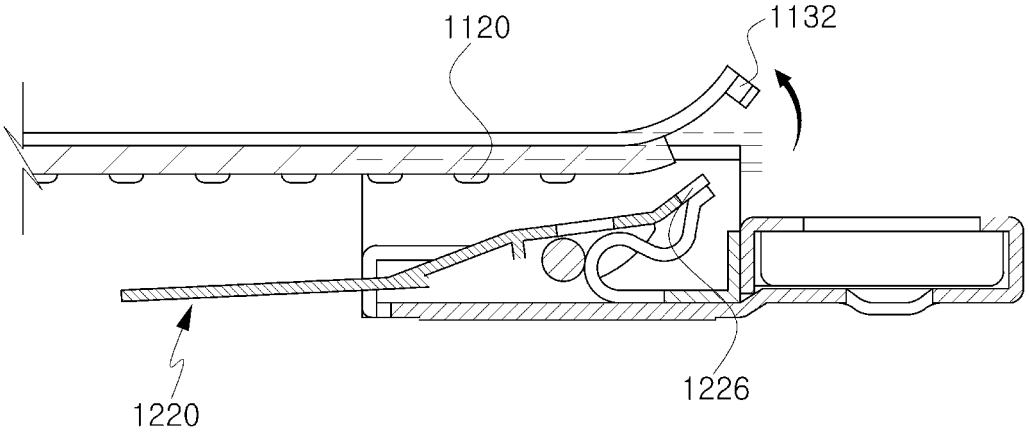

FIGS. 25A and 25B are views illustrating a modified example of the band 1100 which has been described with reference to FIG. 24.

First, referring to FIG. 25A, the band 1100 may include a movement prevention portion 1132 which protrudes in front of a body connection portion 1130 while being spaced apart from the pair of wing portions 1116.

When the pair of wing portions 1116 are moved in the second direction and the band control portion 1220 is released from all the hold portions 1120, the movement prevention portion 1132 is held by the second rear wall 1212*b* in such a way that the pair of wing portions 1116 are temporarily restricted from moving further in the second direction, thereby preventing damage caused by a drop which may occur due to carelessness of the user when the user releases the watch from a wrist.

In other words, as shown in FIG. 25B, when the user desires to separate the watch from the wrist, an external force is applied to the band control portion 1220 and then the band 1100 is moved in the second direction.

In this case, even though the holding portion 1226 of the band control portion 1220 is released from all the hold portions 1120, the movement prevention portion 1132 which protrudes from the body connection portion 1130 is held by the second rear wall 1212*b* of the body portion 1210, thereby temporarily preventing a complete separation from the body portion 1110 of the band 1100.

Accordingly, a sudden drop of the watch may be prevented and the user may stably separate the watch from the wrist by changing a position of the movement prevention portion 1132 using the external force as shown in FIG. 25B.

FIGS. 26 to 29 are views illustrating other modified examples of the band 1100.

Figure 26:
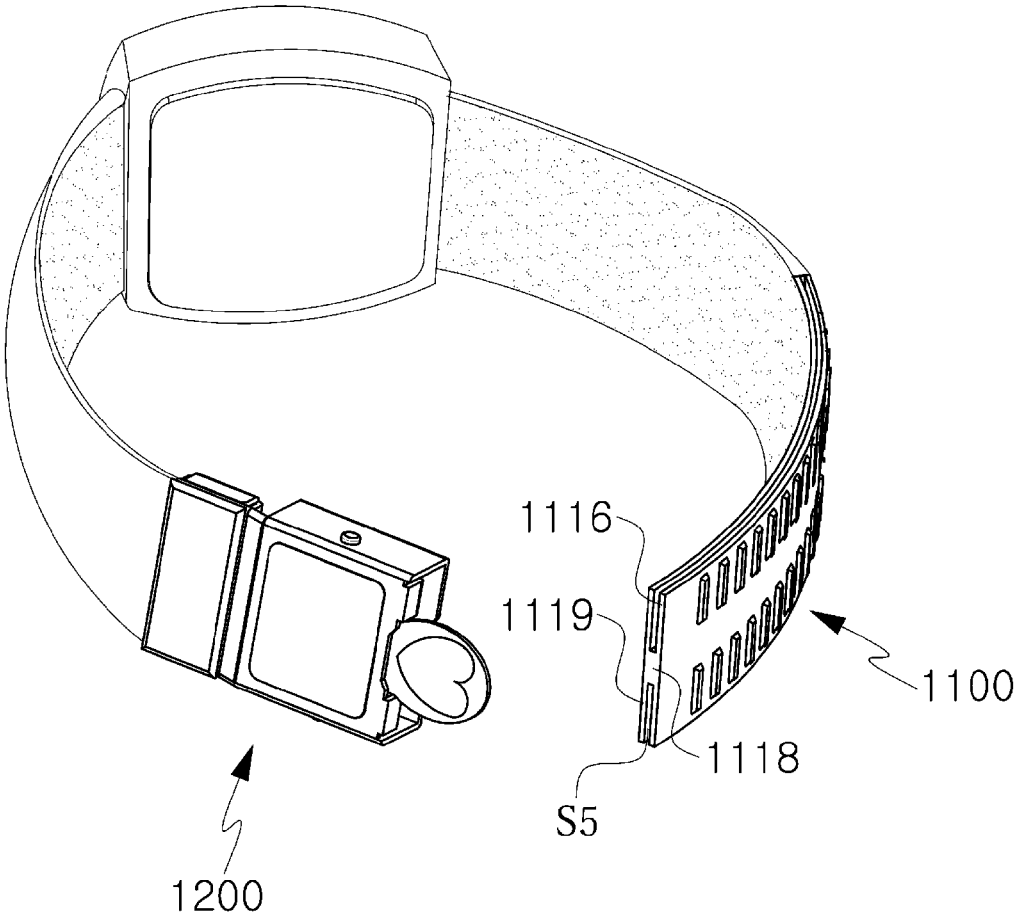
FIGS. 26 to 29 are views illustrating other modified examples of the band.

First, referring to FIG. 26, the band 1100 and the controller 1200 which have been described with reference to FIGS. 1 to 21 are applied to a watch.

The controller 1200 may be attached to one end of a watch strap of the watch, and the band 1100 may be attached to the other end thereof.

Here, the body portion 1110 of the band 1100 may include a pair of auxiliary wing portions 1119 which extend in parallel with the pair of wing portions 1116 to provide the separation space S5 into which the second rear wall 1212*b* of the body portion 1210 is inserted.

Figure 27:
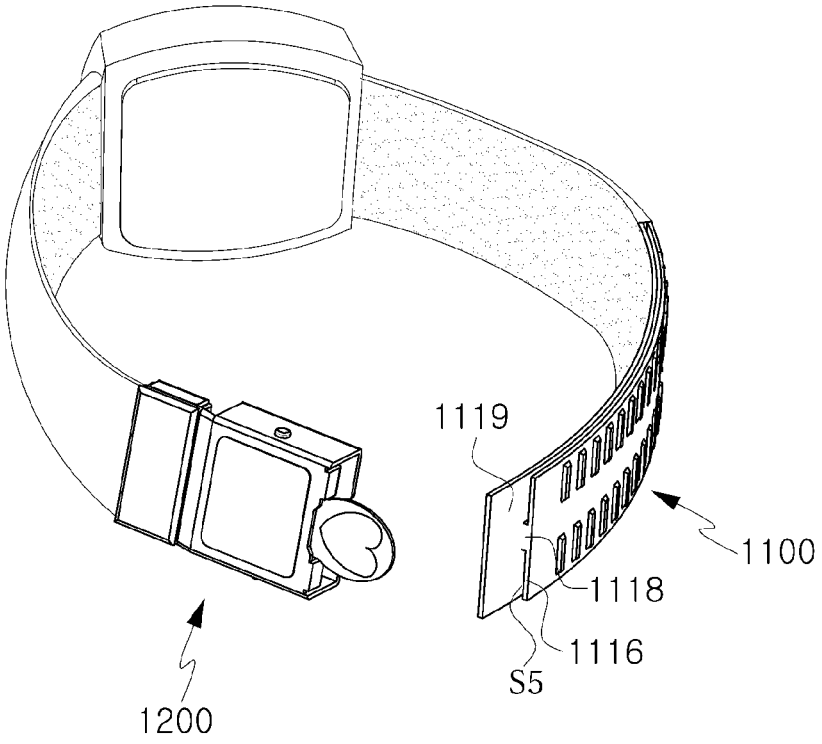

The separation space S5 may be a space into which the second rear wall 1212*b* of the body portion 1210 is inserted while the band 1100 is inserted into the body portion 1210 of the controller 1200. Referring to FIG. 27, compared with FIG. 26, the pair of auxiliary wing portions 1119 may protrude further than the pair of wing portions 1116, thereby guiding the band 1100 when the band 1100 is inserted into the internal space S3 of the body portion 1210 of the controller 1200.

Figure 28:
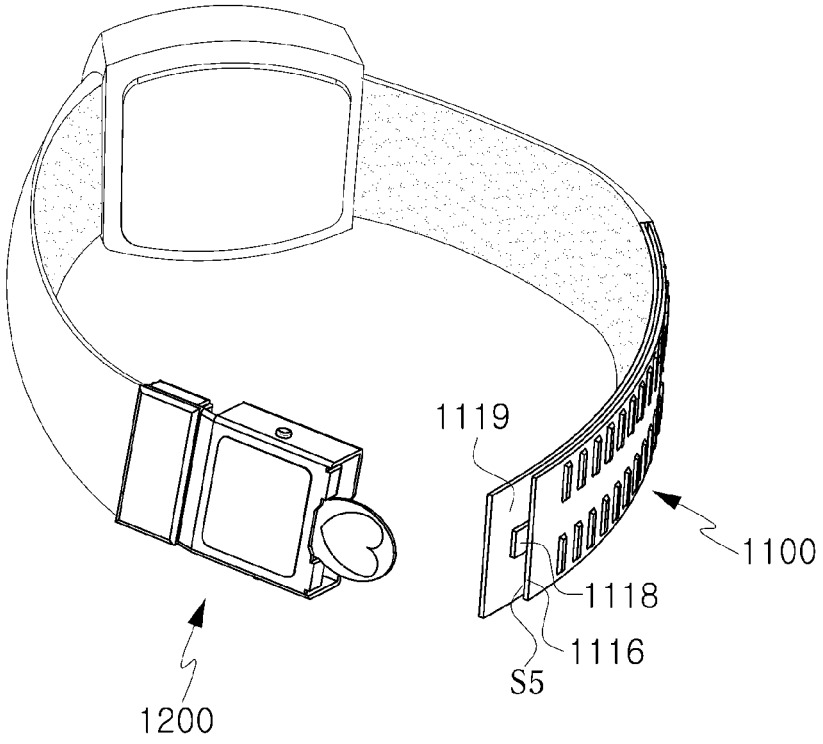
Figure 29:
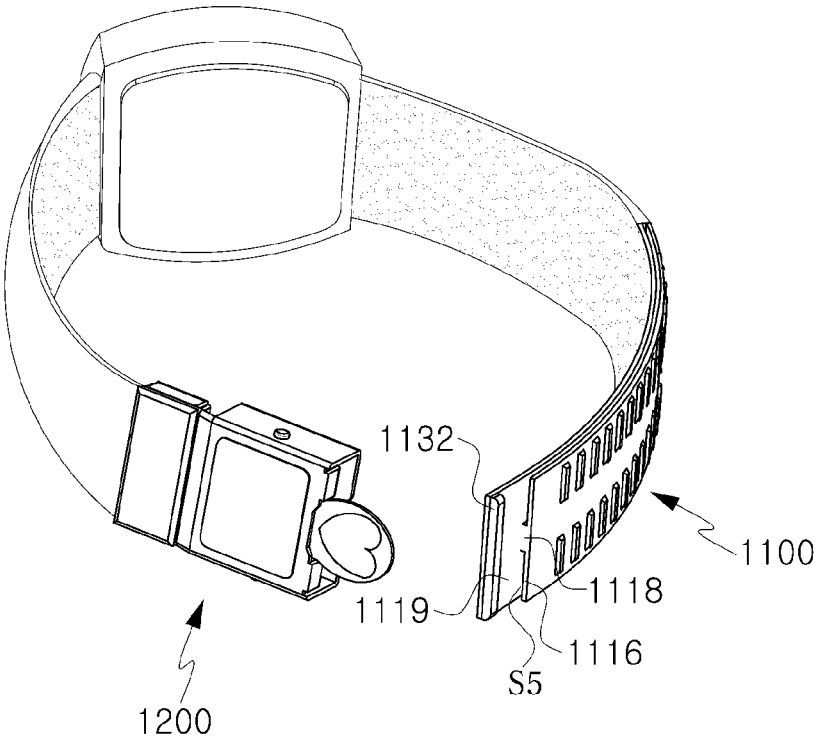

Referring to FIG. 28, compared with FIG. 27, the supporting portion 1118 may protrude further than the pair of wing portions 1116, thereby guiding the band 1100 when the band 1100 is inserted into the internal space S3 of the body portion 1210 of the controller 1200. Referring to FIG. 29, the band 1100 may include the movement prevention portion 1132 which protrudes in front of the pair of auxiliary wing portions 1119 while being spaced apart from the pair of wing portions 1116.

When the pair of wing portions 1116 are moved in the second direction and the holding portion 1226 of the band control portion 1220 is released from all the hold portions 1120, the movement prevention portion 1132 is held by the second rear wall 1212*b* in such a way that the pair of wing portions 1116 are temporarily restricted from moving further in the second direction. An effect obtained according thereto is identical to the described with reference to FIG. 25.

FIGS. 30A to 30D are views illustrating various modified examples of the band 1100 provided in the band adjusting device 1000 according to an embodiment of the present invention.

Figure 30A:
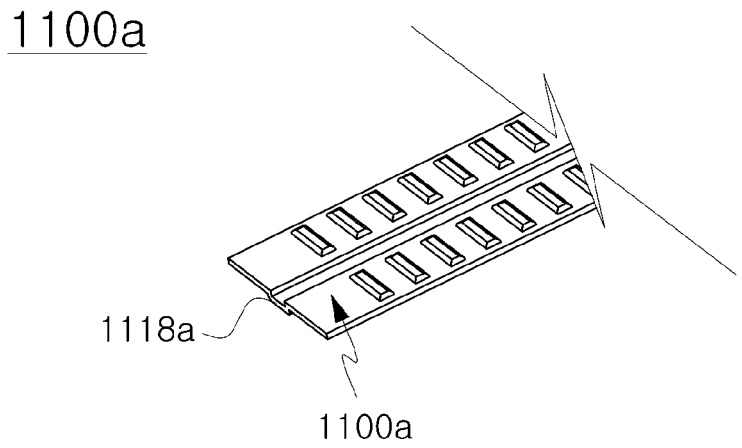
FIGS. 30A to 30D are views illustrating various modified examples of the band provided in the band adjusting device according to an embodiment of the present invention.

First, referring to FIG. 30A, a supporting portion 1118*a* of a band 1100*a* may be depressed from a front side of a body portion 1110*a* in a longitudinal direction and may protrude toward from a rear side thereof.

Figure 30B:
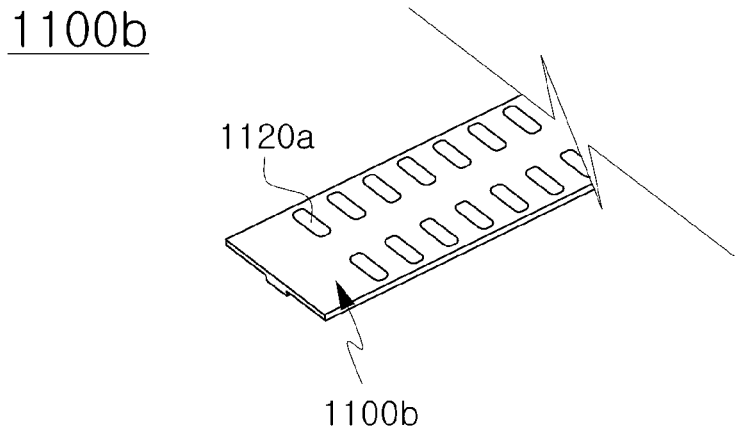

Referring to FIG. 30B, a hold portion 1120*b* of a band 1100*b* may be depressed from a body portion 1110*b*.

Figure 30C:
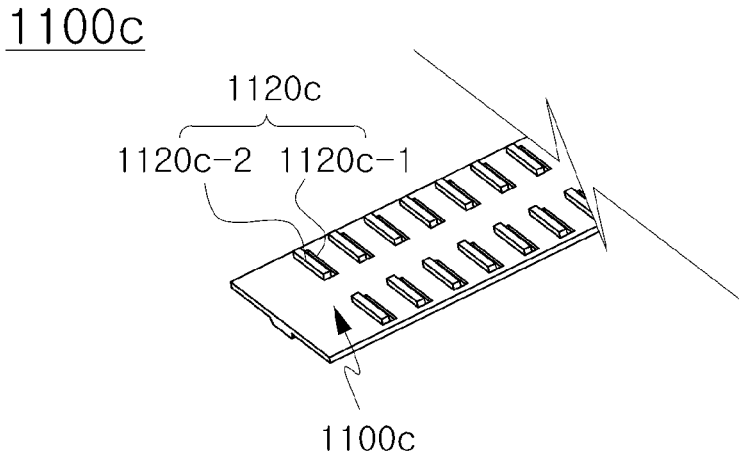

Referring to FIG. 30C, a hold portion 1120*c* of a band 1100*c* may include a concave portion 1120*c*-1 formed on a front side of a body portion 1110*c* by depression thereof and a convex portion 1120*c*-2 formed to be adjacent to the concave portion 1120*c*-1 and to protrude, thereby enlarging an area in which the holding portion 1226 is held by the hold portion 1120*c* to maximize an available load and usage lifetime.

Figure 30D:
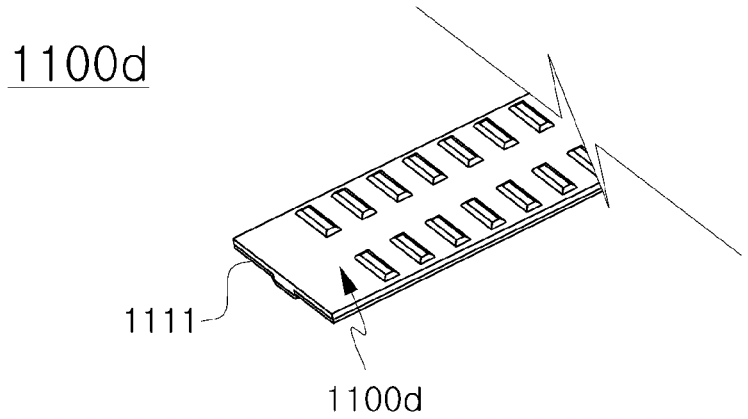

Referring to FIG. 30D, a band 1100*d* may include a thin film portion 1111 mounted on a rear side of a body portion 1110*d* to reduce a frictional force with the second rear wall 1212*b*, may smoothly slide due to the thin film portion 1111, and may maximize an available load and usage lifetime.

Meanwhile, the body portion 1110*d* may be manufactured by injection-molding using a resin such as rubber and the thin film portion 1111 may be formed of a material different from that of the body portion 1110*d*.

The material of the thin film portion 1111 may be variously modified considering performance thereof.

Also, the thin film portion 1111 along with the body portion 1110*d* may be formed by double injection. In this case, a plurality of holes may be formed in the thin film portion 1111, thereby maximizing an adhesive force of the body portion 1110*d* and simultaneously increasing flexibility of the body portion 1110*d*.

Figure 31A:
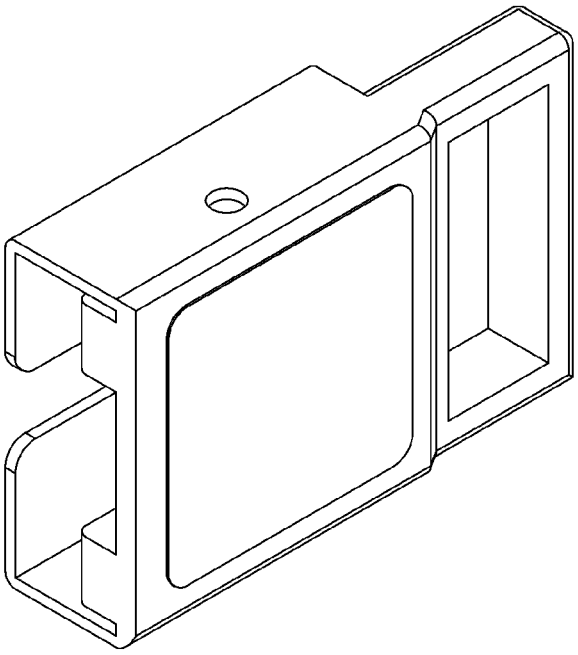
FIGS. 31A to 31B are views illustrating a first modified example of the body portion provided in the band adjusting device according to an embodiment of the present invention.
Figure 31B:
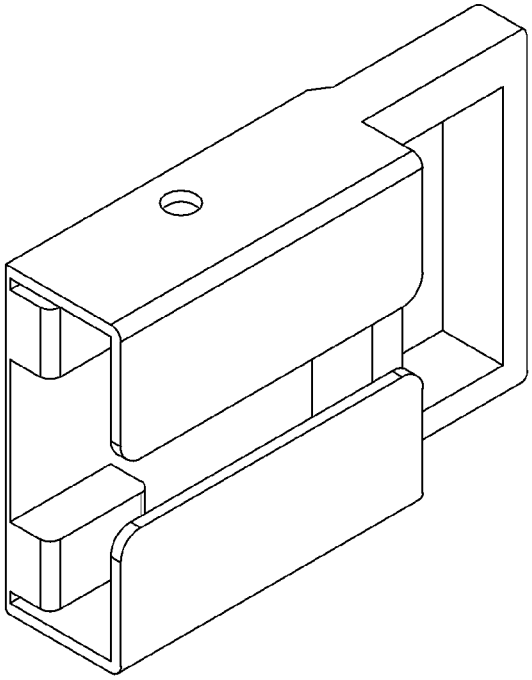

FIGS. 31A to 31B are views illustrating a first modified example of the body portion 1110 provided in the band adjusting device 1000 according to an embodiment of the present invention.

Referring to FIG. 31, a body portion 1200*a* may be manufactured by injection using a plastic resin and a configuration and an effect thereof are identical to the description above.

Figure 32:
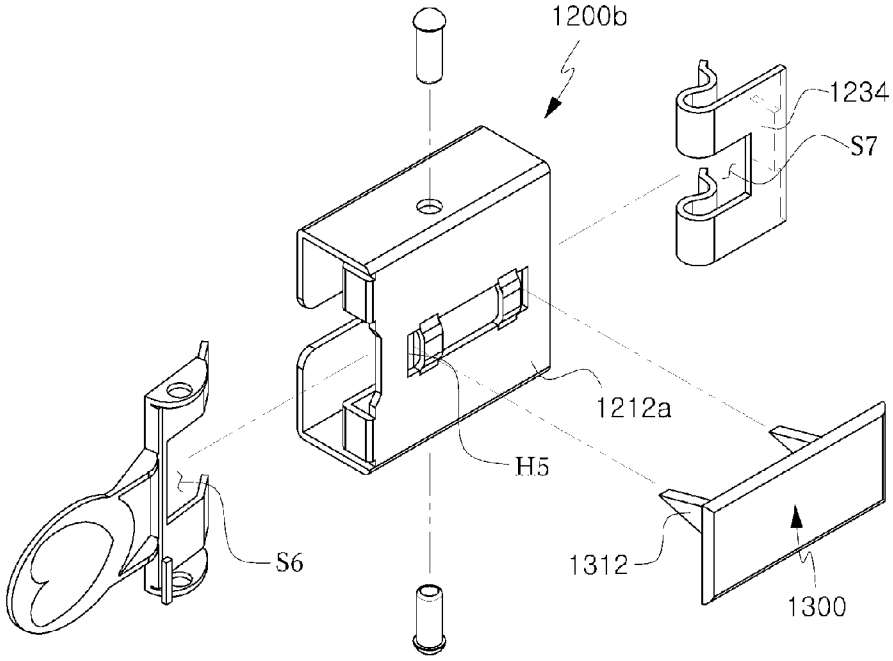
FIG. 32 is a view illustrating a second modified example of the body portion provided in the band adjusting device according to an embodiment of the present invention.

FIG. 32 is a view illustrating a second modified example of the body portion 1110 provided in the band adjusting device 1000 according to an embodiment of the present invention.

Referring to FIG. 32, in the case of a body portion 1200*b*, the attached material connection portion 1214 of the body portion 1220, which has been described with reference to FIGS. 1 to 21, may be removed.

In this case, the connection between an attached material and the body portion 1220*b* may be implemented using a through hole H5 formed in the second front wall 1212*a*.

That is, the second front wall 1212*a* may include the through hole H5 formed to pass therethrough to allow the point portion 1312 of the fixing pin 1300 which is an attached material fixing portion for connecting with the attached material to pass therethrough.

Here, to provide a space for an additional caulking jig for caulking the point portion 1312 which passes through the through hole H5 formed in the second front wall 1212*a*, a plurality of holding portions 1226 of the band control portion 1220 are provided while spaced apart so as not to interfere with the attached material fixing portion to provide an interference prevention space S6.

Also, an approximate central portion of the mounting portion 1232 of the elastic portion 1230 may be cut to provide a space S7 for inserting the caulking jig.

Figure 33A:
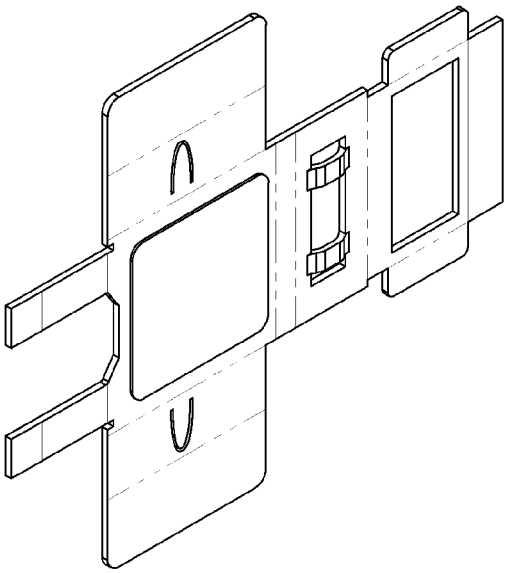
FIGS. 33A to 33C are views illustrating a third modified example of the body portion provided in the band adjusting device according to an embodiment of the present invention.
Figure 33B:
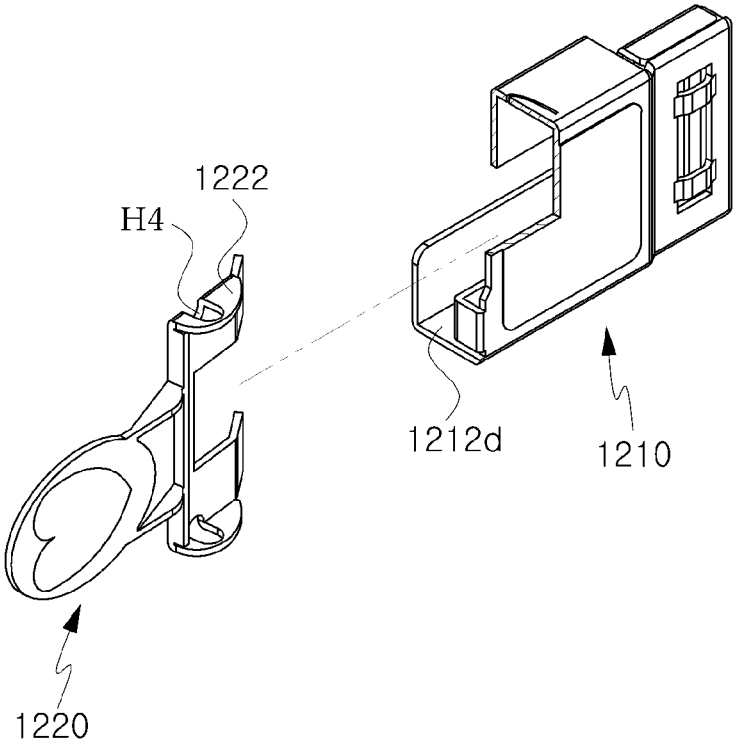
Figure 33C:
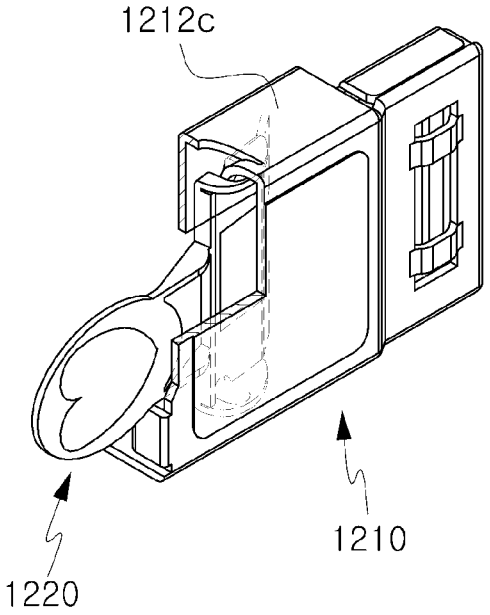

FIGS. 33A to 33C are views illustrating a third modified example of the body portion 1110 provided in the band adjusting device 1000 according to an embodiment of the present invention.

Referring to FIGS. 33A to 33C, the penetration pin P for connecting the body portion 1210 with the band control portion 1220, which has been described with reference to FIGS. 1 to 21, may be omitted. A function of the penetration pin P may be performed by a certain area of the second top wall 1212*c* and a certain area of the bottom wall 1212*d*.

In detail, the rotation axis R about which the band control portion 1220 rotates may be implemented by cutting and bending a certain area of the body portion 1210, that is, the certain area of the second top wall 1212*c* and the certain area of the bottom wall 1212*d*.

First, when manufacturing of the body portion 1210 is completed while the certain area of the second top wall 1212*c* and the certain area of the second bottom wall 1212*d* are cut, the band control portion 1220 is inserted into the internal space S3 to be located in a certain position and then is inserted into the insertion hole H4 of the rotation implementation portion 1222 of the band control portion 1220 by bending.

The rotation axis R may be implemented by the bending, thereby simplifying a manufacturing process.

Meanwhile, the insertion hole H4 formed in the rotation implementation portion 1222 may extend to the connection portion 1228 to prevent interference with the connection portion 1228 in a process in which the certain area of the body portion 1210 is cut and bent to implement the rotation axis R, thereby reducing a size of the body portion 1210 by as much as the thickness of the band control portion 1220.

Figure 34A:
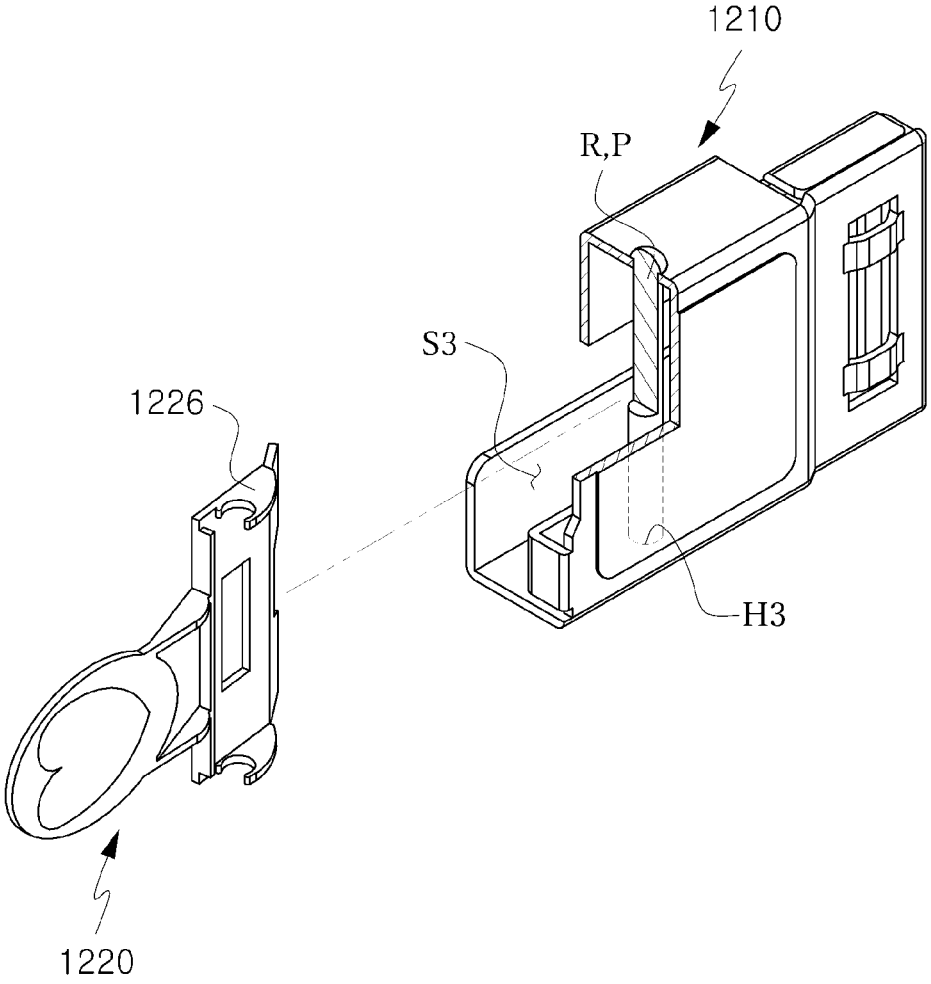
FIGS. 34A to 34B are views illustrating modified examples of the band control portion provided to the band adjusting device according to an embodiment of the present invention.
Figure 34B:
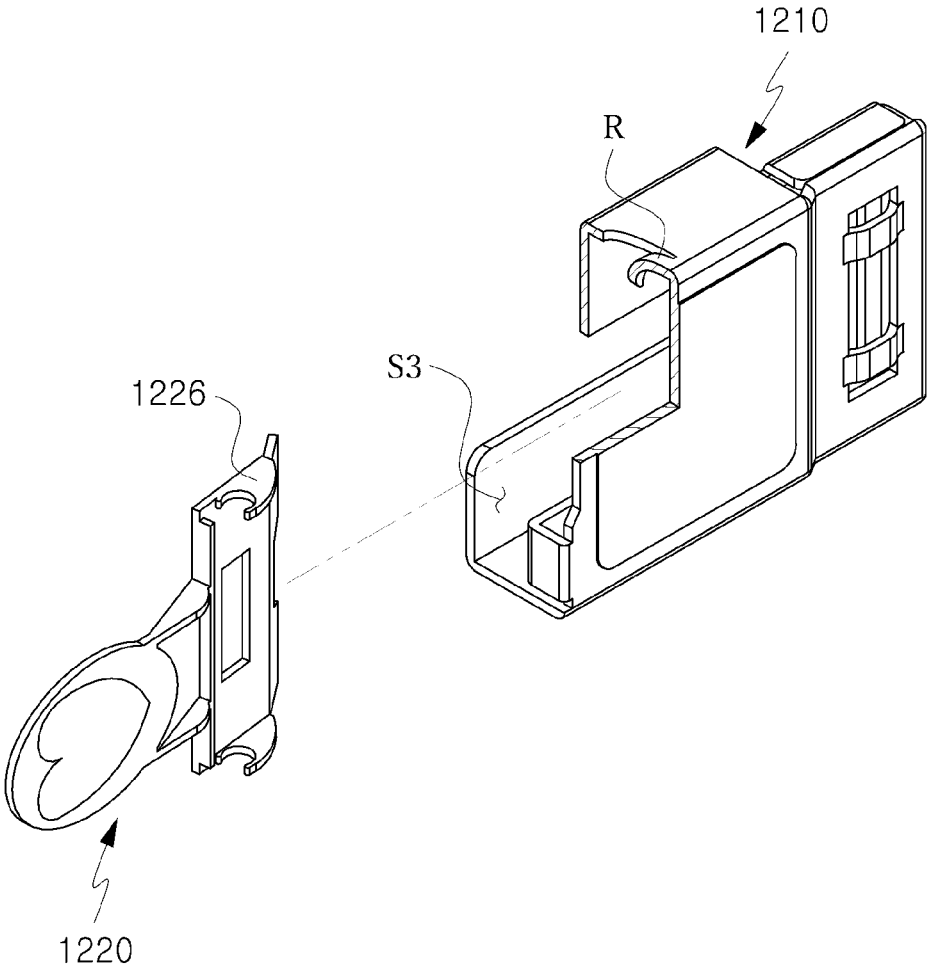

FIGS. 34A to 34B are views illustrating a modified examples of the band control portion 1220 provided to the band adjusting device 1000 according to an embodiment of the present invention.

FIGS. 34A and 34B illustrate cases of implementing the rotation axis R according to the method described with reference to FIGS. 33A to 33C and the method described with reference to FIGS. 1 to 21, respectively.

Here, the rotation implementation portion 1226 of the band control portion 1220 may be formed while one side thereof is open in the second direction to be rotatably mounted on the rotation axis R by a movement toward the rotation axis R.

In detail, in the previous embodiments, a process in which the band control portion 1220 is located in the certain position in the internal space S3 of the body portion 1210 and then a certain area of the body portion 1210 is bent or the penetration pin P is inserted has been performed. However, in the present embodiment, a sequence of the process may be changed due to the rotation implementation portion 1226.

In other words, in FIG. 34A, when manufacturing of the body portion 1210 is completed, the penetration pin P may be inserted into the hole H3 and the band control portion 1220 may be inserted into the internal space S3 of the body portion 1210, which may be implemented by an open area of the rotation implementation portion 1226.

Also, in FIG. 34B, when manufacturing of the body portion 1210 is completed, the rotation axis R is implemented by bending a certain area of the body portion 1210 beforehand and then the band control portion 1220 may be inserted into the internal space S3 of the body portion 1210, which may also be implemented by the open area of the rotation implementation portion 1226.

Meanwhile, despite the open area of the rotation implementation portion 1226, a separation of the band control portion 1220 from the rotation axis R does not occur due to the elastic portion 1230.

According to the method described above, manufacturing costs may be reduced.

Figure 35:
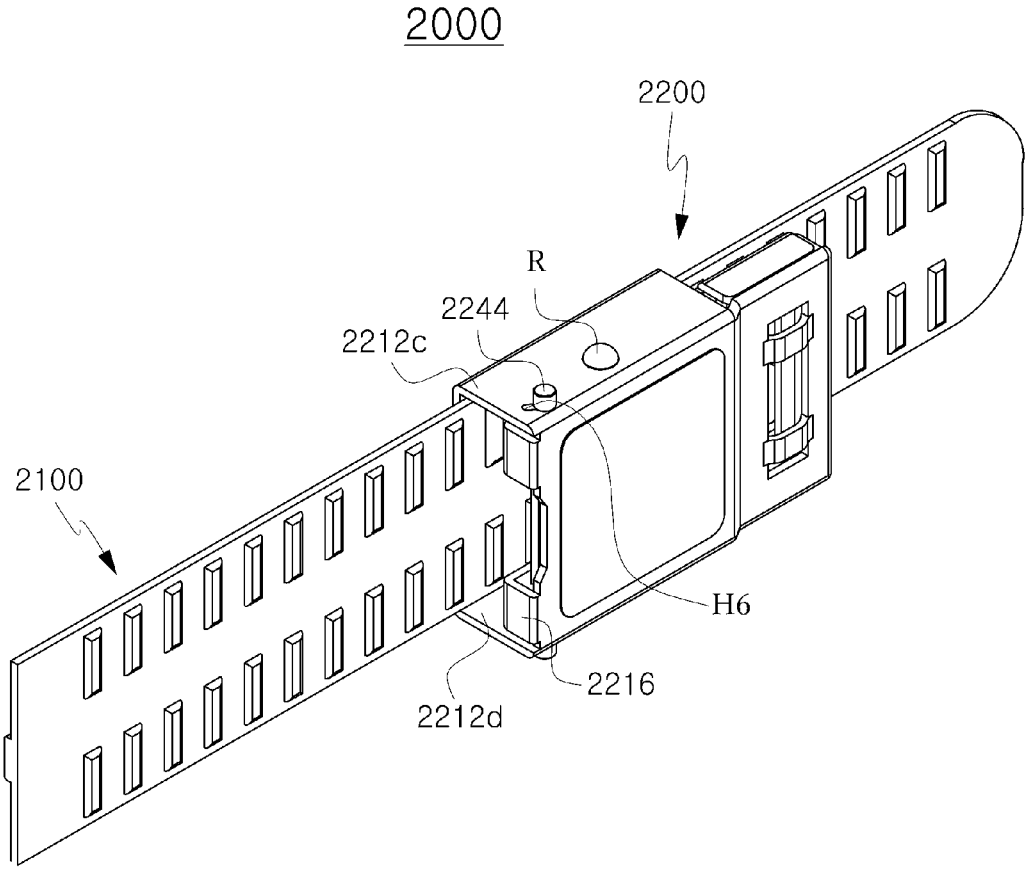
FIG. 35 is a perspective view of a band adjusting device according to another embodiment of the present invention.
Figure 36:
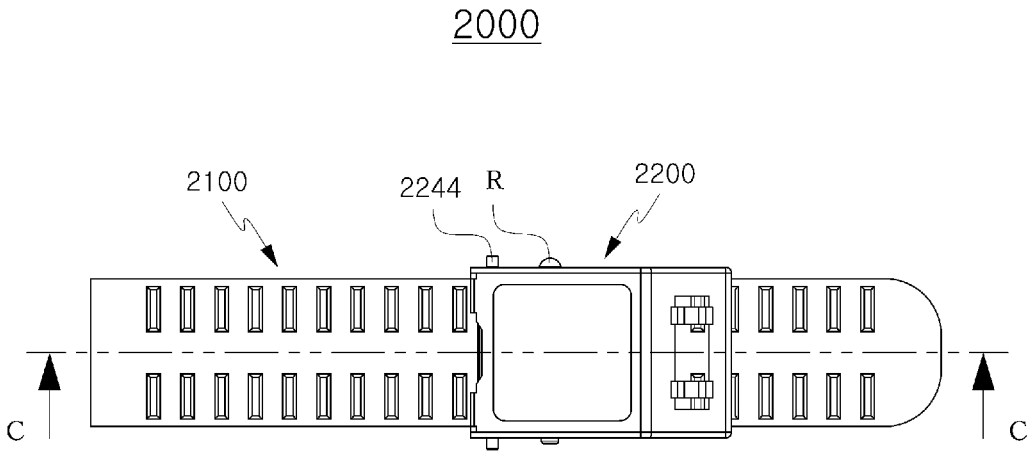
FIG. 36 is a front view of the band adjusting device of FIG. 35.
Figure 37:
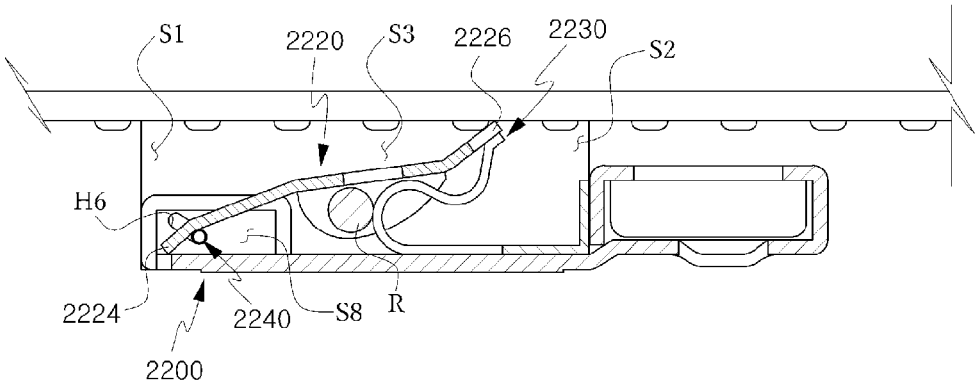
FIG. 37 is a cross-sectional view illustrating a part taken along a line C-C shown in FIG. 36.

FIG. 35 is a perspective view of a band adjusting device 2000 according to another embodiment of the present invention. FIG. 36 is a front view of the band adjusting device 2000 of FIG. 35. FIG. 37 is a cross-sectional view taken along a line C-C shown in FIG. 36.

Figure 38:
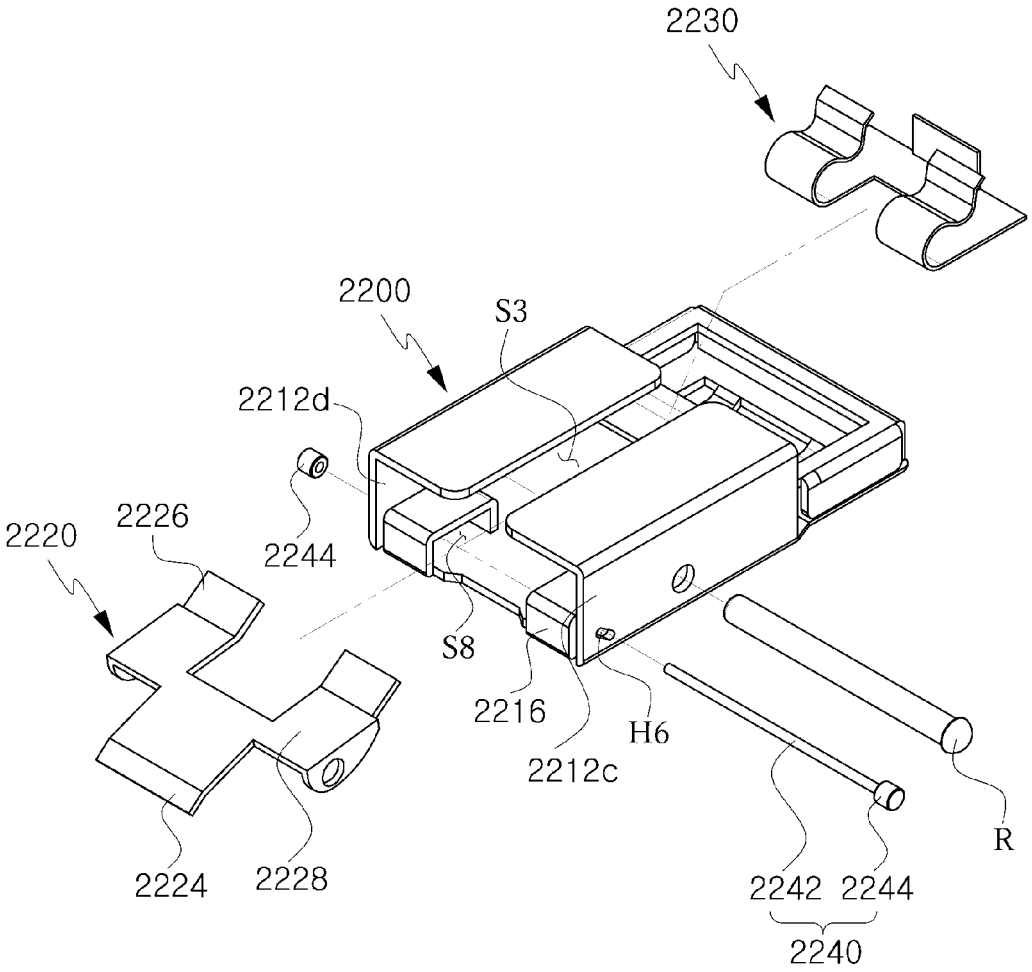
FIG. 38 is an exploded view of a controller provided in the band adjusting device of FIG. 35.
Figure 39:
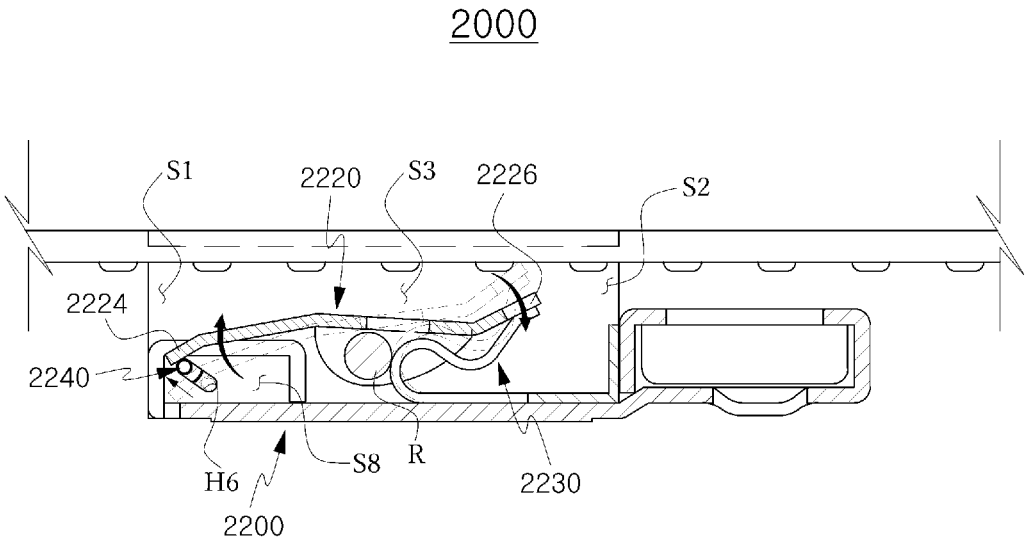
FIG. 39 is a view illustrating a principle by which a band is moved by the controller of FIG. 38.

Also, FIG. 38 is an exploded view of a controller provided in the band adjusting device 2000 of FIG. 35, and FIG. 39 is a view illustrating a principle by which a band 2100 is moved by the band control portion 2220 of FIG. 38.

All components of the band adjusting device 1000 which has been described with reference to FIGS. 1 to 34 may be applied to the band adjusting device 2000 according to another embodiment of the present invention shown in FIGS. 35 to 39 within a compatible range.

Referring to FIGS. 35 to 39, the band adjusting device 2000 according to another embodiment of the present invention is a device which allows a movement of the band 2100 in a first direction to be free but allows a movement thereof in a second direction to be selective and may include the band 2100 and the controller.

The controller may include a body portion 2200, the band control portion 2220, an elastic portion 2230, and an external force transfer portion 2240.

The body portion 2200 may be a component which includes an insertion space S1 in which one end of the band 2100 is inserted and a discharge space S2 through which the one end of the band 2100, inserted into the insertion space S1, is discharged.

Also, the band control portion 2220 may be a component which is located in an internal space S3 of the body portion 2200 not to protrude outside the body portion 2200 and is changeable in position between a first position and a second position based on a rotation axis R to allow the band 2100 to freely move in the first direction while being in contact with the band 2100 in the first position and to allow the band 2100 to freely move in the second direction while not being in contact with the band 2100 in the second position.

Also, the elastic portion 2230 may be a component which is elastically deformed when the band control portion 2220 is changed in position from the first position to the second position due to an external force and is located in the internal space S3 to restore the band control portion 2220 from the second position to the first position using a restoring force caused by the elastic deformation when the external force is removed.

The external force transfer portion 2240 may be a component which is located in a third position while being in contact with the band control portion 2220 to allow the band control portion 2220 to be located in the first position and is changed in position from the third position to a fourth position while being in contact with the band control portion to allow the band control portion 2220 to be changed in position from the first position to the second position.

The band adjusting device 2000 according to another embodiment of the present invention, compared with the band adjusting device 1000 which has been described with reference to FIGS. 1 to 34, may be a device which further includes the external force transfer portion 2240. Due to the external force transfer portion 2240, components such as the band control portion 2220 and the like may be slightly modified.

The external force transfer portion 2240 may be a type of switch for allowing the band 2100 to move in the second direction and may transfer an external force of a user to the band control portion 2220.

The external force transfer portion 2240 may be changed in position from the third position to the fourth position through a straight movement to change the band control portion 2220 in position from the first position to the second position based on a rotation axis R. Here, the third position may be a position shown in FIG. 37 and the fourth position may be a position shown in FIG. 39.

To allow the external force transfer portion 2240 to be mutually changed in position between the third position and the fourth position, the body portion 2200 may include a movement hole H6 which penetrates therethrough.

In detail, the movement hole H6 may be formed while passing through a top wall 2212*c* and a bottom wall 2212*d* of the body portion 2200 and may be formed to be straightly inclined toward the bottom wall 2212*d* in the second direction.

However, the movement hole H6 does not need to be straightly inclined toward the bottom wall 2212*d* but may be formed to be rounded.

The external force transfer portion 2240 may be disposed to be movable in position in the body portion 2200 along the movement hole H6 which penetrates the top wall 2212*c* and the bottom wall 2212*d* and may include a contact portion 2242 and an exposure portion 2244.

The contact portion 2242 may be a component located in the internal space S3 to be in contact with the band control portion 2220. The exposure portion 2244 may be a component connected to the contact portion 2242 to receive the external force from the user while being exposed outside the internal space S3.

Here, the contact portion 2242 may be a type of thin rod and the exposure portion 2244 and the contact portion 2242 may be changed in position from the third position to the fourth position in the top wall 2212*c* and the bottom wall 2212*d* along the movement hole H6 at certain angles with the first direction and the second direction.

When the exposure portion 2244 and the contact portion 2242 are changed in position from the third position to the fourth position, the contact portion 2242 may rotate the band control portion 2220 on the rotation axis R while being in contact with the band control portion 2220.

Here, the contact portion 2242 may be in contact with the band control portion 2220 in an accommodation space S8 provided by a separation-prevention portion 2216 and a specified contact position may be an external force receiving portion 2224 of the band control portion 2220.

The band control portion 2220 may include the external force receiving portion 2224 which receives the external force through a contact with the contact portion 2242 to allow the band 2100 to move in the second direction, a holding portion 2226 which interconnects with the external force receiving portion 2224 and is released from the band 2100 by the external force, and a connection portion 2228 which connects the external force receiving portion 2224 with the holding portion 2226.

As a result, the contact portion 2242 may maintain a contact state with the external force receiving portion 2224 and the external force receiving portion 2224 may be changed in contact position with the contact portion 2242 due to a change in position of the contact portion 2242 from the third position to the fourth position.

Meanwhile, when the contact portion 2242 is located in the third position, a contact part between the external force receiving portion 2224 and the contact portion 2242 may be rounded or may be at a certain angle to increase the contact part with the contact portion 2242, thereby allowing the band control portion 2220 to smoothly rotate on the rotation axis R based on the change in position of the contact portion 2242.

Meanwhile, the exposure portion 2244 and the contact portion 2242 may be prefabricated to be smoothly mounted in the movement hole H6.

In other words, when the band control portion 2220 and the elastic portion 2230 are mounted in the body portion 2200, the external force transfer portion 2240 may be stably mounted in the movement hole H6 to be movable in position by inserting the exposure portion 2244 into the movement hole H6 and the accommodation space S8 and then fastening the contact portion 2242 thereto.

The external force transfer portion 2240 is moved from the third position to the fourth position by the external force from the user to rotate the band control portion 2220 on the rotation axis R to be moved from the first position to the second position. After that, when the external force from the user is removed, the external force transfer portion 2240 may automatically return from the fourth position to the third position due to the restoring force caused by the elastic deformation of the elastic portion 2230.

Figure 40:
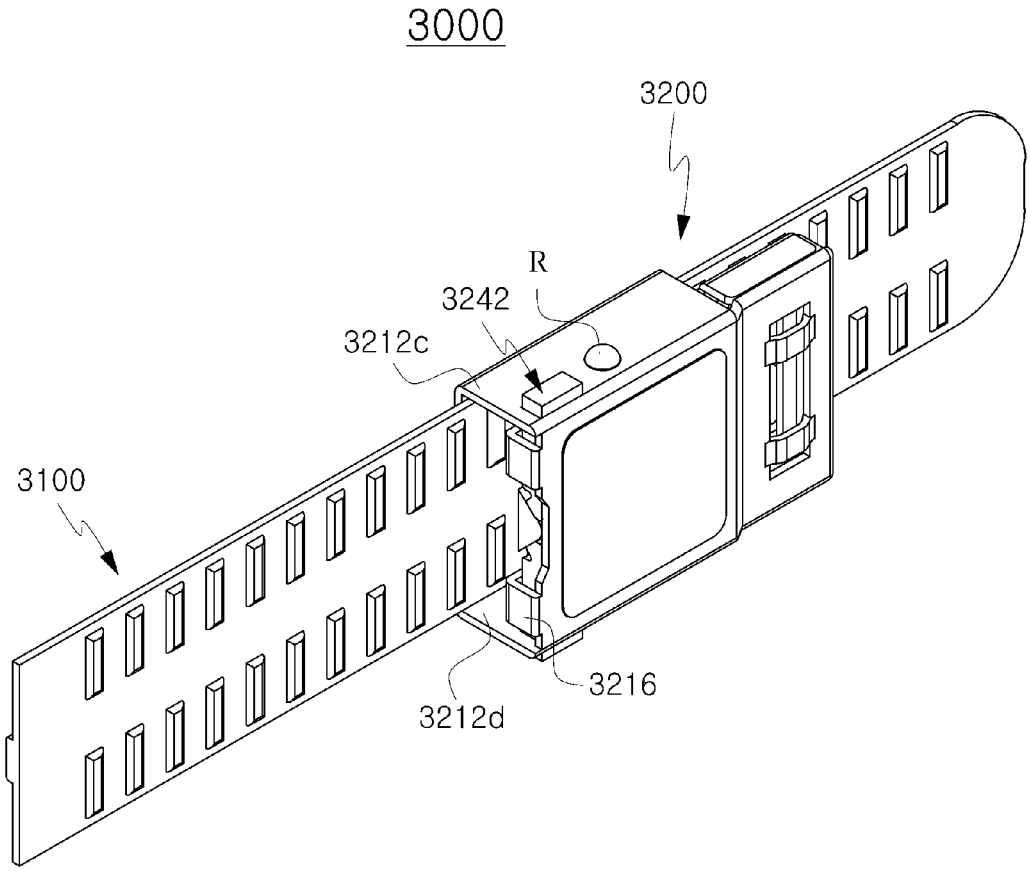
FIG. 40 is a perspective view of a band adjusting device according to still another embodiment of the present invention.
Figure 41:
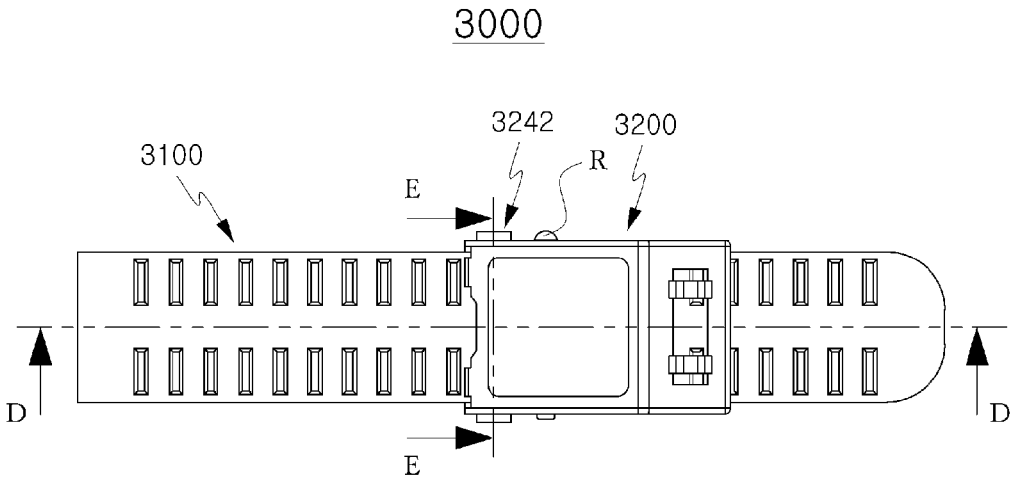
FIG. 41 is a front view of the band adjusting device of FIG. 40.
Figure 42A:
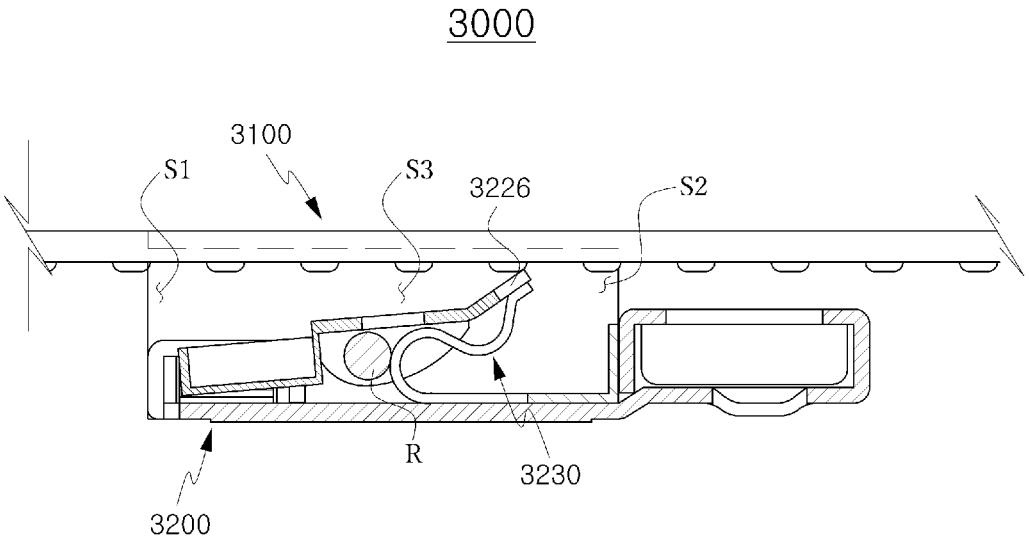
FIGS. 42A and 42B are respective cross-sectional views taken along lines D-D and E-E in FIG. 41.
Figure 42B:
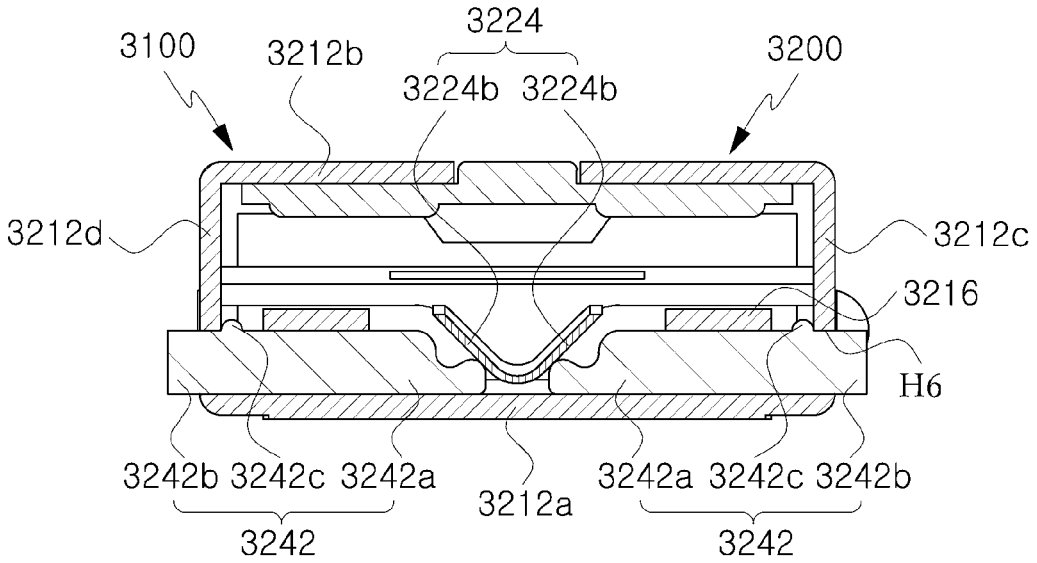

FIG. 40 is a perspective view of a band adjusting device 3000 according to still another embodiment of the present invention. FIG. 41 is a front view of the band adjusting device 3000 of FIG. 40. FIGS. 42A and 42B are cross-sectional views illustrating parts taken along lines D-D and E-E in FIG. 41, respectively.

Figure 43:
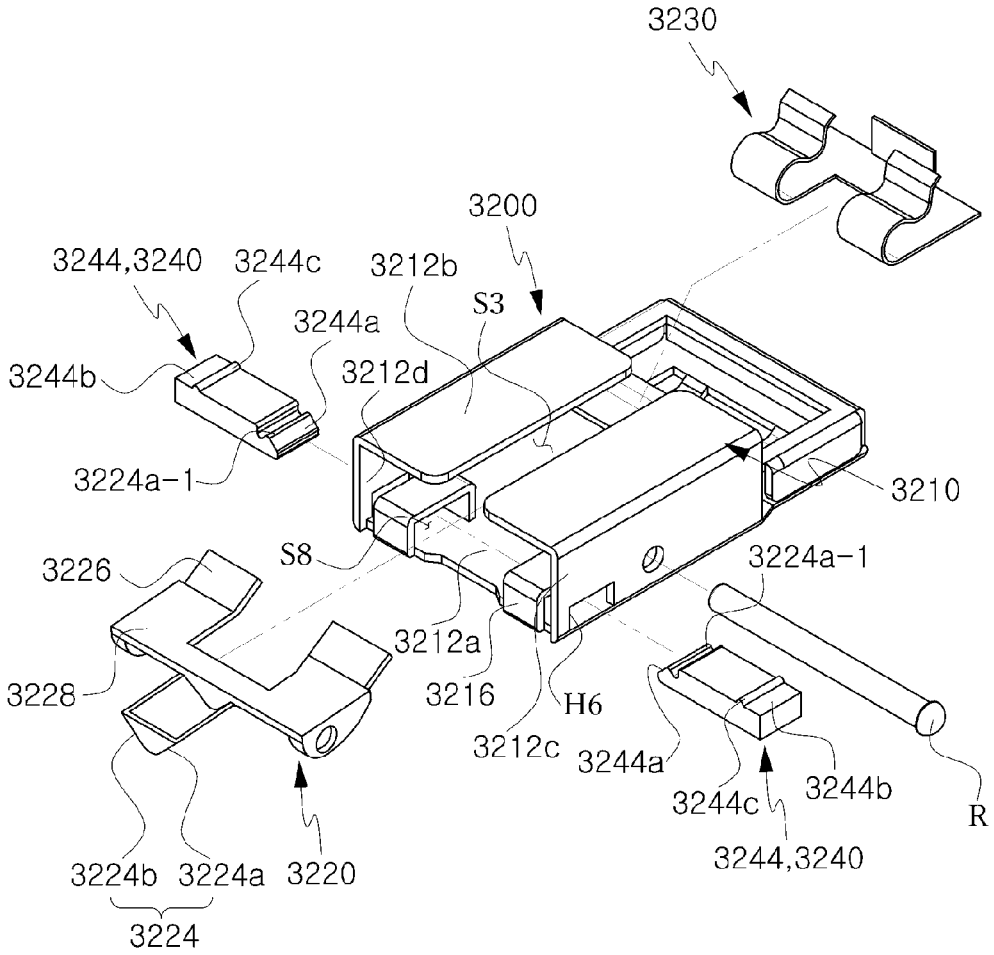
FIG. 43 is an exploded view of a controller provided in the band adjusting device of FIG. 40.
Figure 44:
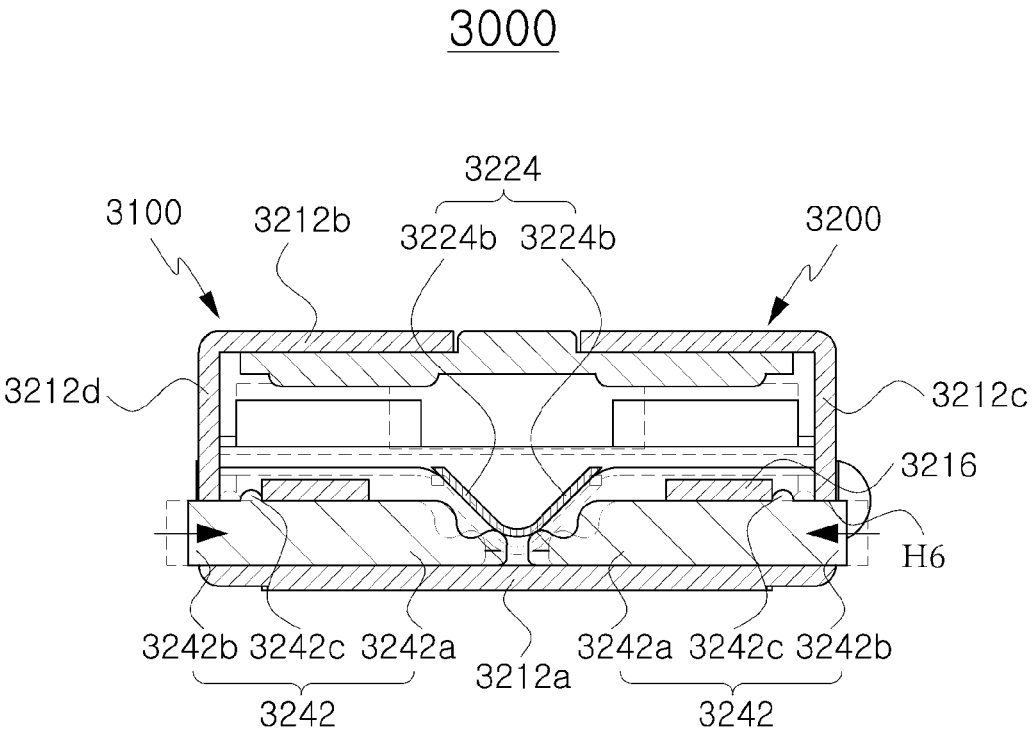
FIG. 44 is a view illustrating a principle by which a band is moved by the controller of FIG. 43.

Also, FIG. 43 is an exploded view of a controller provided in the band adjusting device 3000 of FIG. 40, and FIG. 44 is a view illustrating a principle by which a band 3100 is moved by the band control portion 3220 of FIG. 43.

Referring to FIGS. 40 to 44, all components of the band adjusting device 1000 which has been described with reference to FIGS. 1 to 34 may be applied to the band adjusting device 3000 according to still another embodiment of the present invention within a compatible range.

The band adjusting device 3000 according to still another embodiment of the present invention, compared with the band adjusting device 1000 which has been described with reference to FIGS. 1 to 34, may be a device which further includes an external force transfer portion 3240. Due to the external force transfer portion 3240, components such as the band control portion 3220 and the like may be slightly modified.

Referring to FIGS. 40 to 44, the band adjusting device 3000 according to still another embodiment of the present invention is a device which allows a movement of the band 3100 in a first direction to be free but allows a movement thereof in a second direction to be selective and may include the band 3100 and the controller.

The controller may include a body portion 3200, the band control portion 3220, an elastic portion 3230, and the external force transfer portion 3240.

The external force transfer portion 3240 may be a type of switch for allowing the band 3100 to move in the second direction and may transfer an external force of a user to the band control portion 3220.

The external force transfer portion 3240 may be changed in position from a third position to a fourth position through a straight movement to change the band control portion 2220 in position from a first position to a second position based on a rotation axis R. Here, the third position may be a position shown in FIG. 42 and the fourth position may be a position shown in FIG. 44.

To allow the external force transfer portion 3240 to be mutually changed in position between the third position and the fourth position, the body portion 3200 may include a movement hole H6 which penetrates therethrough.

In detail, the movement hole H6 may be formed while penetrating a top wall 3212*c* and a bottom wall 3212*d* of the body portion 3200 and may be formed to be a straight shape in parallel with the first direction or the second direction.

The external force transfer portion 3240 may include a first external force transfer portion 3242 moved in position from the top wall 3212*c* toward the bottom wall 3212*d* and a second external force transfer portion 3244 moved in position from the bottom wall 3212*d* toward the top wall 3212*c*.

Here, the first external force transfer portion 3242 may include a first contact portion 3242*a* located in an internal space S3 of the body portion 3200 to be in contact with the band control portion 3220 and a first exposure portion 3242*b* connected to the first contact portion 3242*a* while being exposed outside the internal space S3. The second external force transfer portion 3244 may include a second contact portion 3244*a* located in the internal space S3 to be in contact with the band control portion 3220 and a second exposure portion 3244*b* connected to the second contact portion 3244*a* while being exposed outside the internal space S3.

The first contact portion 3242*a* and the second contact portion 3244*a* are changed in position from the third position to the fourth position to rotate the band control portion 3220 on the rotation axis R.

Meanwhile, the first external force transfer portion 3242 may include a first stopper 3242*c* which protrudes from a boundary between the first exposure portion 3242*b* and the first contact portion 3242*a* to be in contact with the top wall 3212*c* to prevent the first contact portion 3242*a* from being deviated outside the internal space S3 in the third position.

Also, the second external force transfer portion 3244 may include a second stopper 3244*c* which protrudes from a boundary between the second exposure portion 3244*b* and the second contact portion 3244*a* to be in contact with the bottom wall 3212*d* to prevent the second contact portion 3244*a* from being deviated outside the internal space S3 in the third position.

When the band control portion 3220 and the elastic portion 3230 are mounted in the body portion 3200, the first external force transfer portion 3242 and the second external force transfer portion 3244 may be forcibly inserted into the movement hole H6 of the body portion 3200. Here, the first stopper 3242*c* and the second stopper 3244*c* pass through the movement hole H6 while being held by the top wall 3212*c* and the bottom wall 3212*d*, respectively.

The first stopper 3242*c* and the second stopper 3244*c* which pass through the movement hole H6 are held by insides of the top wall 3212*c* and the bottom wall 3212*d* in the internal space S3, thereby preventing the first external force transfer portion 3242 and the second external force transfer portion 3244 from being deviated outside the body portion 3200.

Here, the first contact portion 3242*a* and the second contact portion 3244*a* which pass through the movement hole H6 may be accommodated in an accommodation space S8 of a separation-prevention portion 3216 and may be restricted in moving in position toward a rear wall 3212*b* of the body portion 3200 by the separation-prevention portion 3216.

The body portion 3200 may include a frame portion 3210 which defines an insertion space S1 and a discharge space S2 and the separation-prevention portion 3216 which extends from the frame portion 3210 to be in contact with the band control portion 3220 to prevent a separation of the band control portion 3220 when the band control portion 3220 is located in the second position.

The separation-prevention portion 3216 may include the accommodation space S8 which accommodates the first contact portion 3242*a* and the second contact portion 3244*a* to allow the first contact portion 3242*a* and the second contact portion 3244*a* to be located in contact with the band control portion 3220 while restricting the first contact portion 3242*a* and the second contact portion 3244*a* in moving in position toward the rear wall 3212*b*.

As a result, the first external force transfer portion 3242 and the second external force transfer portion 3244 are stably located in the accommodation space S8 of the separation-prevention portion 3216 and may be prevented from moving in position toward the bottom wall 3212*d* by one side wall of the separation-prevention portion 3216.

Meanwhile, the first contact portion 3242*a* may include a first contact surface 3242*a*-1 at an irregular distance from the front wall 3212*a* in a direction from the top wall 3212*c* to the bottom wall 3212*d*, and the second contact portion 3244*a* may include a second contact surface 3244*a*-1 at an irregular distance from the front wall 3212*a* in a direction from the bottom wall 3212*d* to the top wall 3212*c*.

The first contact portion 3244*a*-1 and the second contact portion 3244*a*-2 may be formed to be rounded, and in detail, parts in contact with the band control portion 3220 may protrude while being rounded to allow the band control portion 3200 to smoothly rotate by minimizing contact areas with the band control portion 3220.

Here, the band control portion 3220 may include a component to allow the external force to be stably transferred from the first external force transfer portion 3242 and the second external force transfer portion 3244.

In detail, the band control portion 3220 may include an external force receiving portion 3224 which receives the external force through contacts with the first contact portion 3242*a* and the second contact portion 3244*a* to allow the band 3100 to move in the second direction, a holding portion 3226 which interconnects with the external force receiving portion 3224 and is released from the band 3100 by the external force, and a connection portion 3228 which connects the external force receiving portion 3224 with the holding portion 3226.

The external force receiving portion 3224 may include a first external force receiving portion 3224*a* and a second external force receiving portion 3224*b* in contact with the first contact portion 3242*a* and the second contact portion 3244*a*. The first external force receiving portion 3224*a* may be formed to be inclined to the rear wall 3212*b* from the bottom wall 3212*d* toward the top wall 3212*c*. The second external force receiving portion 3224*b* may be formed to be inclined to the rear wall 3212*b* from the top wall 3212*c* toward the bottom wall 3212*d*.

Accordingly, due to the external force receiving portion 3224, the first contact portion 3242*a*, and the second contact portion 3244*a*, the band control portion 3220 may be stably moved in position based on the rotation axis R by movements in position of the first external force transfer portion 3242 and the second external force transfer portion 3244.

Meanwhile, when the external force transfer portion 3240 is changed in position from the third position to the fourth position and then the external force is removed, the external force transfer portion 3240 may automatically return to the third position due to a restoring force caused by elastic deformation of the elastic portion 3230.

Figure 45:
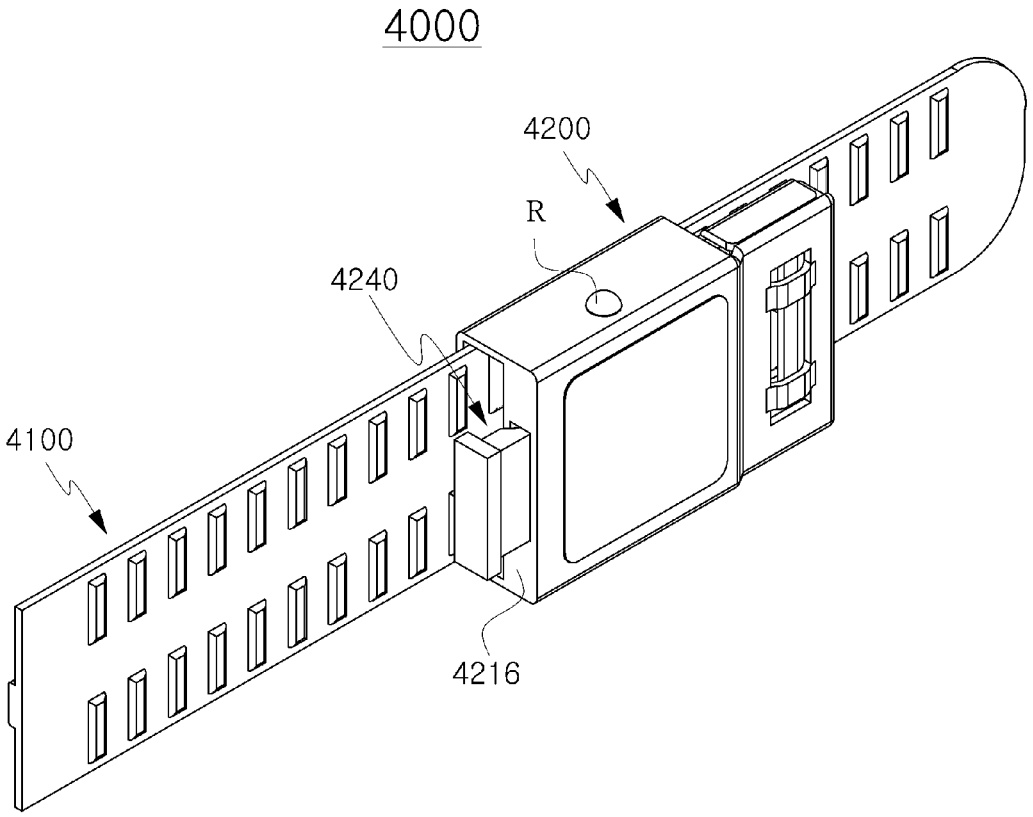
FIG. 45 is a perspective view of a band adjusting device according to yet another embodiment of the present invention.
Figure 46:
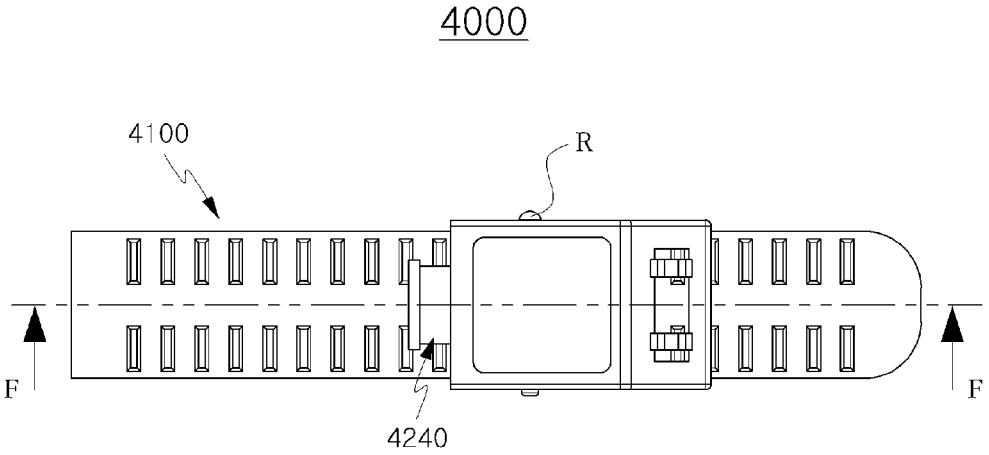
FIG. 46 is a front view of the band adjusting device of FIG. 45.
Figure 47:
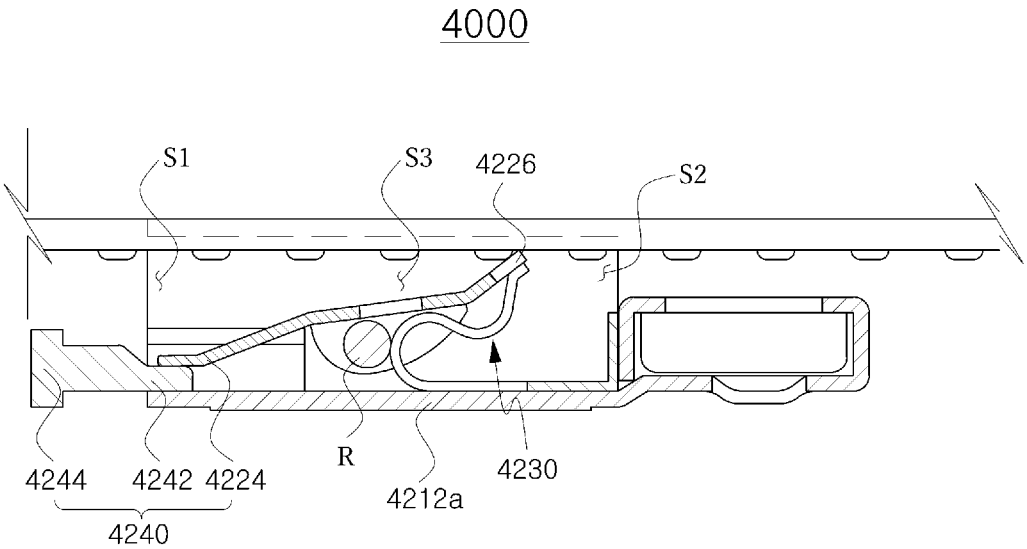
FIG. 47 is a cross-sectional view illustrating a part taken along a line F-F' shown in FIG. 46.

FIG. 45 is a perspective view of a band adjusting device 4000 according to yet another embodiment of the present invention. FIG. 46 is a front view of the band adjusting device 4000 of FIG. 45. FIG. 47 is a cross-sectional view taken along a line F-F shown in FIG. 46.

Figure 48:
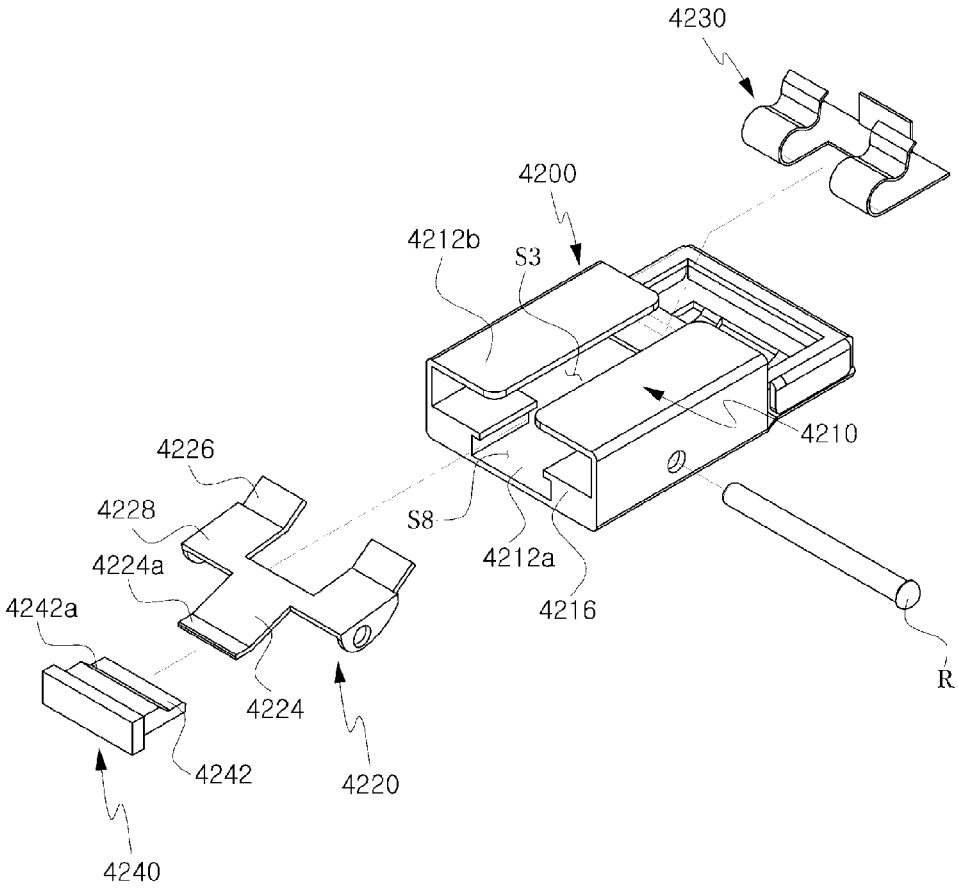
FIG. 48 is an exploded view of a controller provided in the band adjusting device of FIG. 45.
Figure 49:
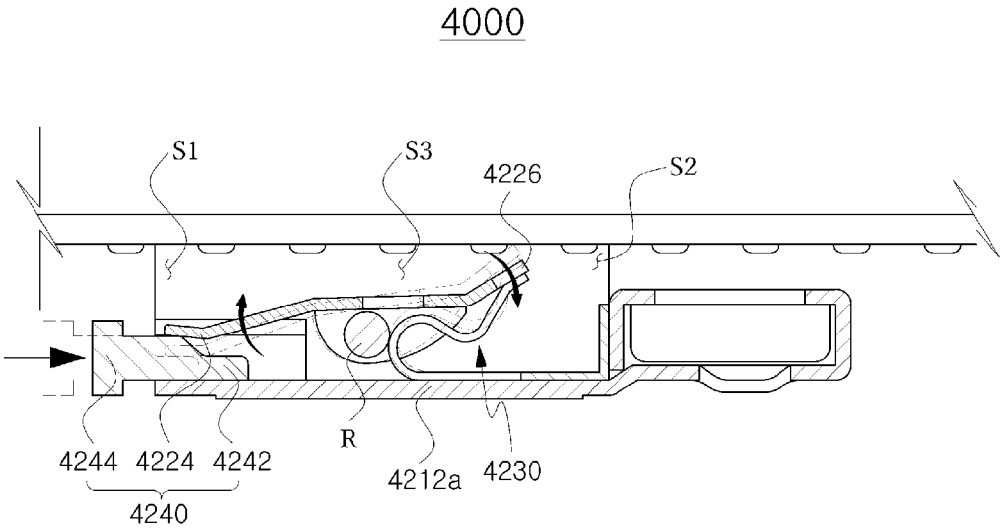
FIG. 49 is a view illustrating a principle by which a band is moved by the controller of FIG. 48.

Also, FIG. 48 is an exploded view of controller provided in the band adjusting device 4000 of FIG. 45, and FIG. 49 is a view illustrating a principle by which a band 4100 is moved by the band control portion 4220 of FIG. 48.

Referring to FIGS. 45 to 49, all components of the band adjusting device 1000 which has been described with reference to FIGS. 1 to 34 may be applied to the band adjusting device 4000 according to yet another embodiment of the present invention within a compatible range.

The band adjusting device 4000 according to yet another embodiment of the present invention, compared with the band adjusting device 1000 which has been described with reference to FIGS. 1 to 34, may be a device which further includes an external force transfer portion 4240. Due to the external force transfer portion 4240, components such as the band control portion 4220 and the like may be slightly modified.

Referring to FIGS. 45 to 49, the band adjusting device 4000 according to yet another embodiment of the present invention is a device which allows a movement of the band 4100 in a first direction to be free but allows a movement thereof in a second direction to be selective and may include the band 4100 and the controller.

The controller may include a body portion 4200, the band control portion 4220, an elastic portion 4230, and the external force transfer portion 4240.

The external force transfer portion 4240 may be a type of switch for allowing the band 4100 to move in the second direction and may transfer an external force of a user to the band control portion 4220.

The external force transfer portion 4240 may be changed in position from a third position to a fourth position through a straight movement to change the band control portion 4220 in position from a first position to a second position based on a rotation axis R. Here, the third position may be a position shown in FIG. 47 and the fourth position may be a position shown in FIG. 49.

The external force transfer portion 4240 may be slidably mounted on a part of the body portion 4200 which extends in the first direction but is not limited thereto and may be located in the third position using an additional member.

The external force transfer portion 4240 may include a contact portion 4242 located in an internal space S3 of the body portion 4200 to be in contact with the band control portion 4220 and an exposure portion 4244 connected to the contact portion 4242 while being exposed outside the internal space S3.

Here, the exposure portion 4244 may be moved in position in the first direction to be changed in position from the third position to the fourth position in such a way that the contact portion 4242 may allow the band control portion 4220 to rotate on the rotation axis R.

The contact portion 4242 may include a contact surface 4242*a* at an irregular distance from a front wall 4212*a* in the first direction. A part of the contact surface 4242*a* in contact with the band control portion 4220 may protrude to be rounded to allow the band control portion 4220 to smoothly rotate by minimizing a contact area with the band control portion 4220.

Here, the band control portion 4220 may include a component which allows the external force to be stably transferred from the external force transfer portion 4240.

In detail, the band control portion 4220 may include an external force receiving portion 4224 which receives the external force through a contact with the contact portion 4242 to allow the band 4100 to move in the second direction, a holding portion 4226 which interconnects with the external force receiving portion 4224 and is released from the band 4100 by the external force, and a connection portion 4228 which connects the external force receiving portion 4224 with the holding portion 4226.

The external force receiving portion 4224 may include an inclined surface 4224*a* formed to be inclined to a rear wall 4212*b* of the body portion 4200 in the second direction to allow the exposure portion 4244 to smoothly rotate on the rotation axis R when moving in the first direction.

Accordingly, due to the external force receiving portion 4224 and the contact portion 4242, the band control portion 4220 may be stably moved in position based on the rotation axis R by a movement in position of the external force transfer portion 4240.

Meanwhile, the body portion 4200 may include a frame portion 4210 which defines an insertion space S1 and a discharge space S2 and a separation-prevention portion 4216 which extends from the frame portion 4210 to be in contact with the band control portion 4220 to prevent a separation of the band control portion 4220 when the band control portion 4220 is located in the second position.

Also, a plurality of such separation-prevention portions 4216 includes an accommodation space S8 therebetween to allow the contact portion 4242 to be located in contact with the band control portion 4220. Here, the contact portion 4242 may be restricted in moving in position toward the rear wall 4212*b*.

Meanwhile, when the external force transfer portion 4240 is changed in position from the third position to the fourth position and then the external force is removed, the external force transfer portion 4240 may automatically return to the third position due to a restoring force caused by elastic deformation of the elastic portion 4230.

As is apparent from the embodiments described above, a controller, a band, and a band adjusting device may be further reduced in number of components to simplify a manufacturing process thereof, thereby reducing manufacturing costs.

Also, sliding of the band may be smoothly performed and easily operated at the same time, thereby providing convenience to a user.

Also, a size thereof may be reduced to maximize the field of application. When it is applied to watches, watches may be prevented from falling off due to carelessness of the user.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A controller which allows a movement of a band in a first direction to be freely performed but allows a movement of the band in a second direction opposite to the first direction to be selectively performed, comprising:

a body portion which comprises an insertion space into which one end of the band is inserted and a discharge space through which the one end of the band inserted into the insertion space is discharged;

a band control portion which is mounted to be changeable in position between a first position and a second position based on a rotation axis, is in contact with the band and allows the band to freely move in the first direction in the first position, and is not in contact with the band and allows the band to freely move in the second direction; and an elastic portion which is elastically deformed when the band control portion is changed in position from the first position to the second position due to an external force and is located to be immovable in the first direction and the second direction in an internal space of the body portion to restore the band control portion from the second position to the first position using a restoring force caused by the elastic deformation when the external force is removed, a frame portion which defines the insertion space and the discharge space, and a separation-prevention portion which extends from the frame portion to be in contact with the band control portion to prevent the band control portion from separating in the second direction.

2. The controller of claim 1, wherein the body portion further comprises an attached material connection portion which extends from the frame portion to be connected to an attached material, and wherein the elastic portion is prevented from moving in the first direction in the internal space due to contact with one surface of the attached material connection portion.

3. The controller of claim 1, wherein the band control portion comprises a rotation implementation portion to be rotatable on the rotation axis to allow a mutual change in position between the first position and the second position, and wherein the frame portion of the body portion comprises a tab that extends inward into an insertion hole of the rotation implementation portion, the tab defining the rotation axis.

4. The controller of claim 3, wherein the band control portion comprises an external force receiving portion which receives the external force for implementing the movement of the band in the second direction, a holding portion which interconnects with the external receiving portion and is released from the band due to the external force, and a connection portion which connects the external force receiving portion, the holding portion, and the rotation implementation portion to one another, wherein the rotation implementation portion extends from the connection portion at a certain angle, and wherein the insertion hole extends to the connection portion.

5. The controller of claim 1, wherein the band control portion comprises a rotation implementation portion to be rotatable on the rotation axis to allow a change in position between the first position and the second position, wherein the rotation axis is defined by an inwardly extending tab of the frame portion of the body portion or by a penetration pin which passes through the body portion, and wherein the rotation implementation portion has an open one side in the second direction to be rotatably mounted on the rotation axis due to a movement in position toward the rotation axis.

6. The controller of claim 1, wherein the body portion is in contact with the elastic portion so as not to allow the elastic portion to move in the first direction to the internal space, and wherein the rotation axis is in contact with the elastic portion so as not to allow the elastic portion to move in the second direction in the internal space.

7. The controller of claim 1, wherein the band control portion comprises a rotation implementation portion to be rotatable on the rotation axis to allow a mutual change in position between the first position and the second position, and wherein the separation-prevention portion provides a through space having a certain size in the body portion to allow the rotation implementation portion to pass therethrough when the band control portion is inserted into the internal space.

8. The controller of claim 1, wherein the body portion comprises a front wall, a ear wall, a top wall, and a bottom wall, which define the internal space, and a discharge-space-defining wall to allow the discharge space to be defined by a relationship with the rear wall, and wherein the elastic portion comprises a mounting portion mounted on the front wall, a restriction portion which extends from the mounting portion to be in contact with the discharge-space-defining wall in the internal space to restrict a movement in position in the first direction, and an elastic deformation portion which extends from the mounting portion to be elastically deformed by a change in position of the band control portion.

9. The controller of claim 8, wherein the restriction portion and the elastic deformation portion extend from opposite ends of the mounting portion, and wherein a boundary between the mounting portion and the elastic deformation portion is in contact with the rotation axis to restrict a movement in position in the second direction.

10. The controller of claim 9, wherein the elastic deformation portion is formed to be rounded to prevent a reduction in restoring force during elastic deformation.

11. The controller of claim 8, wherein the band control portion comprises an external force receiving portion which receives the external force to implement the movement of the band in the second direction, a holding portion which interconnects with the external force receiving portion and is released from the band due to the external force, and a connection portion which connects the external force receiving portion with the holding portion, wherein the second front wall comprises a through hole which passes therethrough to allow an attached material fixing portion for connection with an attached material to pass therethrough, and wherein a plurality of holding portions are provided and are spaced apart to provide an interference prevention space so as not to interfere with the attached material fixing portion.

* * * * *